US008945805B2

(12) United States Patent
Baba et al.

(10) Patent No.: US 8,945,805 B2
(45) Date of Patent: Feb. 3, 2015

(54) MAGNETIC CARRIER AND TWO-COMPONENTS DEVELOPER

(75) Inventors: Yoshinobu Baba, Yokohama (JP); Koh Ishigami, Mishima (JP); Naoki Okamoto, Mishima (JP); Tomoko Endo, Odawara (JP)

(73) Assignee: Canon Kabushiki Kaisha, Tokyo (JP)

( * ) Notice: Subject to any disclaimer, the term of this patent is extended or adjusted under 35 U.S.C. 154(b) by 1007 days.

(21) Appl. No.: 12/810,725

(22) PCT Filed: Feb. 26, 2009

(86) PCT No.: PCT/JP2009/054101

§ 371 (c)(1),
(2), (4) Date: Jun. 25, 2010

(87) PCT Pub. No.: WO2009/110522

PCT Pub. Date: Sep. 11, 2009

(65) Prior Publication Data

US 2010/0273103 A1 Oct. 28, 2010

(30) Foreign Application Priority Data

Mar. 6, 2008 (JP) ..... 2008-056498
Aug. 6, 2008 (JP) ..... 2008-203252

(51) Int. Cl.
*G03G 9/113* (2006.01)
*G03G 9/08* (2006.01)

(52) U.S. Cl.
CPC ..... *G03G 9/1133* (2013.01); *G03G 9/0819* (2013.01); *G03G 9/0827* (2013.01)
USPC ..... 430/111.35; 430/111.1; 430/111.2; 430/111.3; 430/111.31; 430/111.32; 430/111.33; 430/111.34; 430/111.4; 430/111.41; 430/110.4; 430/108.6

(58) Field of Classification Search
USPC ..... 430/111.35, 110.4, 108.6, 111.4, 430/111.1–111.41
See application file for complete search history.

(56) References Cited

U.S. PATENT DOCUMENTS 5,239,342 A * 8/1993 Kubo et al. ..... 430/122.7
5,340,677 A 8/1994 Baba et al. ..... 430/106.6

(Continued)

FOREIGN PATENT DOCUMENTS

EP 0 974 873 A2 1/2000
EP 1 477 864 A1 11/2004

(Continued)

OTHER PUBLICATIONS

International Preliminary Report on Patentability issued Sep. 16, 2010 in International Application No. PCT/JP2009/054101—5 pages.

(Continued)

*Primary Examiner* — Peter Vajda
*Assistant Examiner* — Olatunji Godo
(74) *Attorney, Agent, or Firm* — Fitzpatrick, Cella, Harper and Scinto

(57) ABSTRACT

The present invention provides an image of high image quality by using a magnetic carrier coated with a novel coating resin composition. Further, the present invention stably provides a good image which is hardly influenced by environmental fluctuation and long-term use and has a superior stability of a charging amount when left to stand especially under high temperature and high humidity environments. The present invention also provides a magnetic carrier characterized in that a carrier core surface is coated with a copolymer containing at least, as copolymerization components, an acrylic monomer having a specific structure and an acrylic macromonomer having a specific structure.

8 Claims, 5 Drawing Sheets

(56) References Cited

U.S. PATENT DOCUMENTS

| | | | | |
|---|---|---|---|---|
| 5,554,477 | A * | 9/1996 | Ozawa et al. | 430/111.3 |
| 5,573,880 | A | 11/1996 | Mayama et al. | 430/106.6 |
| 5,576,133 | A | 11/1996 | Baba et al. | 430/106.6 |
| 5,932,387 | A | 8/1999 | Yamamoto et al. | |
| 2009/0047592 | A1 * | 2/2009 | Okamoto et al. | 430/109.3 |

FOREIGN PATENT DOCUMENTS

| | | |
|---|---|---|
| JP | 10-307430 | 11/1998 |
| JP | 2007-279588 | 10/2007 |
| WO | WO 2007138912 A1 * | 12/2007 |

OTHER PUBLICATIONS

Korean Office Action dated Mar. 14, 2012 in Korean Application No. 10-2010-7021586.

European Search Report dated Sep. 21, 2012 in European Application No. 09717866.9.

* cited by examiner

MAGNETIC CARRIER AND TWO-COMPONENTS DEVELOPER

TECHNICAL FIELD

The present invention relates to a magnetic carrier incorporated in a developer used for an electrophotography and an electrostatic recording process and a two-components developer having the magnetic carrier and a toner.

BACKGROUND ART

A process of developing an electrostatic image in electrophotography is to form an image by adhering charged toner particles on the electrostatic image using the electrostatic interaction of the electrostatic image. The developer for developing the electrostatic image includes a one-component developer using a magnetic toner comprising a magnetic material dispersed in a resin and a two-components developer which is used by mixing a non-magnetic toner with a magnetic carrier. The latter is preferably used especially for a full-color copying machine for which high image quality is demanded or a full-color image forming apparatus such as a full-color printer and the like.

As the magnetic carrier used in the two-components developer, there is used a coated carrier in which the surface of ferrite particles or a magnetic material-dispersion type resin core is coated with a resin for the purpose of stabilizing the charging amount and improving the endurance of the carrier.

A lot of proposals have been made for the coated carrier, for example, as a durable carrier which prevents charge injection, there is proposed a carrier coated with a fluorine resin obtained by using a specific monomer (Japanese Patent Application Laid-Open No. H10-307430). In this case, uniform coating properties are also improved by using the specific fluorine resin. However, since fluorine has a strong negative charging property and the rising of the charging amount may be slow for a negative toner, especially when an image having a low printing ratio is continuously printed under a low humidity, the charging amount may be increased.

In addition, there is proposed a carrier which is coated with a copolymer of a specific monomer and a methyl methacrylate monomer and has a contact angle of 95° or more for water (Japanese Patent Application Laid-Open No. 2007-279588). Since the charging stability can be achieved and the releasing property can be improved by the use of such a coating resin, the carrier is excellent in durable stability. However, the adhesion between the core and the coating resin is unstable depending on the kinds of the core material and the coating resin is peeled off in some cases. When a machine is allowed to stand for a few days after long-term use especially under high temperature and high humidity environments, the charging amount may be decreased and fog may occur when an image is output.

DISCLOSURE OF THE INVENTION

It is an object of the present invention to provide a magnetic carrier and a two-components developer with which the above problems have been solved.

It is further another object of the present invention to provide a magnetic carrier and a two-components developer which are excellent in developing property and are capable forming an image of high image quality.

It is still further another object of the present invention to provide a magnetic carrier and a two-components developer which are excellent in environmental stability and in stability of the charging amount when they are allowed to stand after long-term use and are capable of providing an image which is stable for a long period of time.

The present invention relates to a magnetic carrier characterized in that the carrier core surface is coated with a copolymer at least containing a monomer having a structure represented by the following formula (A1) and a macromonomer having a structure represented by the following formula (A2) as copolymerization components.

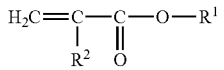

(A1)

(In the formula, $R^1$ represents a hydrocarbon group having 4 or more carbon atoms and $R^2$ represents H or $CH_3$.)

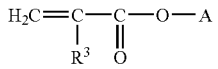

(A2)

(In the formula, A represents a polymer containing, as a polymerization component, one or two or more compounds selected from the group consisting of methyl acrylate, methyl methacrylate, butyl acrylate, butyl methacrylate, 2-ethylhexyl acrylate, 2-ethylhexyl methacrylate, styrene and acrylonitrile, and $R^3$ represents H or $CH_3$.)

In addition, the present invention relates to a two-components developer containing the magnetic carrier and a toner, characterized in that the toner has i) toner particles having a binder resin and a colorant, has ii) a weight average particle diameter (D4) of 3.0 μm or more and 8.0 μm or less and has iii) an average circularity of 0.940 or more and 1.000 or less.

By using the magnetic carrier of the present invention, an image of high image quality may be obtained, and a good image may be stably obtained which is little influenced by environmental fluctuation and long-term use and has a superior stability of the charging amount when left to stand especially under high temperature and high humidity environments.

Further features of the present invention will become apparent from the following description of exemplary embodiments with reference to the attached drawings.

BRIEF DESCRIPTION OF THE DRAWINGS

FIGS. 1A and 1B are schematic cross-sectional views of an apparatus for measuring specific resistance of a magnetic carrier, a core carrier, a magnetic material used in the present invention, carbon black and the like. FIG. 1A is a view in blank state before placing a sample, and FIG. 1B is a view illustrating a state when a sample is placed;

FIG. 2A shows the measured results of the carrier H and FIG. 2B shows the measured results of the carrier P;

BEST MODES FOR CARRYING OUT THE INVENTION

Figure 1A:
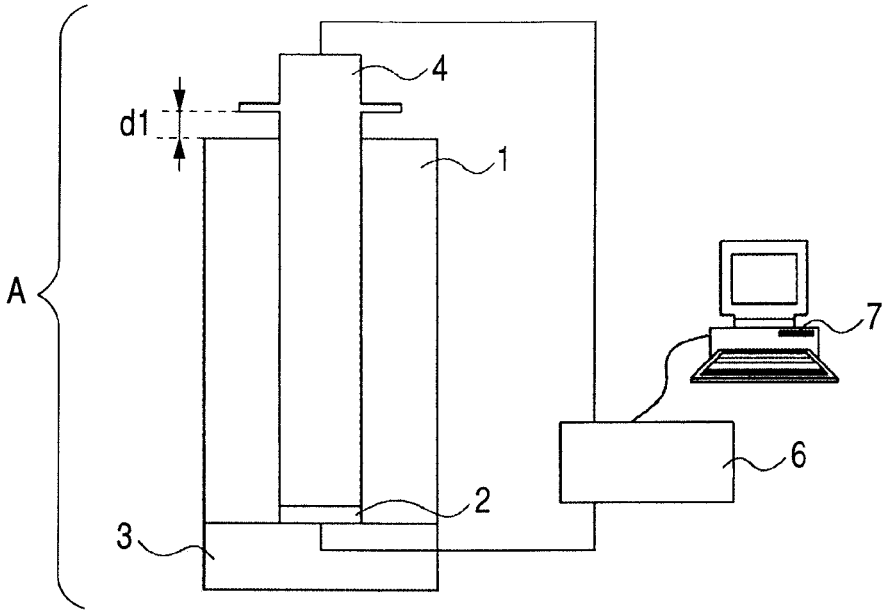

Hereinafter, the present invention will be described in detail.

<Magnetic Carrier>

A copolymer coating the surface of the carrier core will be explained.

The copolymer used for coating the surface of the carrier core in the present invention contains at least, as copolymerization components, a monomer having a structure represented by the following formula (A1) and a macromonomer having a structure represented by the following formula (A2).

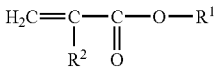

(A1)

(In the formula, $R^1$ represents a hydrocarbon group having 4 or more carbon atoms and $R^2$ represents H or $CH_3$.)

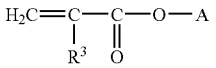

(A2)

(In the formula, A represents a polymer containing, as a polymerization component, one or two or more compounds selected from the group consisting of methyl acrylate, methyl methacrylate, butyl acrylate, butyl methacrylate, 2-ethylhexyl acrylate, 2-ethylhexyl methacrylate, styrene and acrylonitrile, and $R^3$ represents H or $CH_3$.)

By using the monomer having a structure represented by the formula (A1) as a copolymerization component, the crystallinity of the resulting resin is increased, and when the carrier core surface is coated with the resin, the releasing property with the toner may be improved. And, a friction charge can be quickly imparted to the toner and the adherence of the toner can be reduced, thereby enabling to obtain high developing property. In the monomer having a structure represented by the formula (A1), $R^1$ has preferably 4 or more carbon atoms and more preferably 30 or less carbon atoms.

In addition, as the hydrocarbon group in which $R^1$ has 4 or more carbon atoms, there may be either a chain hydrocarbon group or a cyclic hydrocarbon group. As the monomer having a structure represented by the above formula (A1) having a hydrocarbon group in which $R^1$ has 4 or more carbon atoms, there may be mentioned, for example, butyl acrylate, isobutyl acrylate, t-butyl acrylate, 2-ethylhexyl acrylate, lauryl acrylate, dodecyl acrylate, tridecyl acrylate, tetradecyl acrylate, pentadecyl acrylate, hexadecyl acrylate, heptadecyl acrylate, octadecyl acrylate, cyclobutyl acrylate, cyclopentyl acrylate, cyclohexyl acrylate, cycloheptyl acrylate, dicyclopentenyl acrylate, dicyclopentanyl acrylate, butyl methacrylate, isobutyl methacrylate, t-butyl methacrylate, 2-ethylhexyl methacrylate, lauryl methacrylate, dodecyl methacrylate, tridecyl methacrylate, tetradecyl methacrylate, pentadecyl methacrylate, hexadecyl methacrylate, heptadecyl methacrylate, octadecyl methacrylate, cyclobutyl methacrylate, cyclopentyl methacrylate, cyclohexyl methacrylate, cycloheptyl methacrylate, dicyclopentenyl methacrylate and dicyclopentanyl methacrylate.

Further, the monomer having a structure represented by the formula (A1) exists as the following unit in a copolymer.

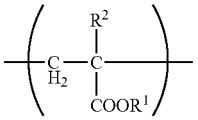

(In the formula, $R^1$ represents a hydrocarbon group having 4 or more carbon atoms and $R^2$ represents H or $CH_3$.)

In addition, the copolymer according to the present invention contains a macromonomer having a structure represented by the above formula (A2) as a copolymerization component. By using the monomer represented by the formula (A2) as a copolymerization component, the adhesion between the carrier core and the coating resin layer may be increased, thereby improving the toughness and abrasion resistance of the coating resin layer. Thus, the magnetic carrier is excellent in stability of the charging amount when allowed to stand after long-term use.

Further, A in the formula (A2) is a polymer containing, as a polymerization component, one or two or more compounds selected from the group consisting of methyl acrylate, methyl methacrylate, butyl acrylate, butyl methacrylate, 2-ethylhexyl acrylate, 2-ethylhexyl methacrylate, styrene and acrylonitrile. The number n of the unit derived from the monomer constituting A in the formula (A2) is preferably 20 or more and 100 or less. If the number n of the unit is within the above range, a sufficient toughness of the coating layer is obtained and the influence of the steric hindrance is small, and thus the copolymerization of the main chain proceeds favorably. A in the formula (A2) preferably has a weight average molecular weight of 3000 or more and 10000 or less. In order to further improve the adhesion and to further reduce the residual monomer content, A more preferably has a weight average molecular weight of 4000 or more and 7000 or less.

A methyl methacrylate monomer is more preferably copolymerized with the copolymer in addition to a monomer represented by the above formula (A1) and a macromonomer represented by the above formula (A2). By adding the methyl methacrylate monomer as a copolymerization component, the charge-imparting performance to the toner can be enhanced and the toner charging amount under high temperature and high humidity environments can be increased, thereby enabling to suppress the environmental fluctuation of the toner charging amount. This is speculated that since the methyl methacrylate unit has a positive charging property and has some hydrophilicity, the balance with the hydrophobicity which the unit of a monomer represented by the formula (A1) has is maintained and thus the environmental fluctuation is suppressed.

The copolymerization ratio (unit ratio) on a mass basis of a monomer of the formula (A1) to a macromonomer of the formula (A2) is preferably from 99.5:0.5 to 70:30. In addition, in the copolymer, the copolymerization ratio of the methyl methacrylate monomer is preferably 1% by mass or more and less than 5% by mass.

The copolymer used in the present invention may be obtained by a conventionally well-known method. Specifically, there may be mentioned an emulsification polymerization method, a suspension polymerization method, a dispersion polymerization method, a solution polymerization method and the like.

Further, the coated layer of the carrier core surface may be incorporated with fine particles for the purpose of enhancing the charge-imparting performance, improving the developing property or suppressing the charge-up of the carrier. The fine particles incorporated in the coated resin layer may be particles of either organic materials or inorganic materials, but are preferably cross-linked resin fine particles or inorganic fine particles having a strength of capable of retaining the shape of the fine particles in coating. The cross-linked resin forming the cross-linked resin fine particles includes cross-linked polymethacrylate resin, cross-linked polystyrene resin, melamine resin, guanamine resin, urea resin, phenol resin and nylon resin. In addition, the inorganic fine particles include magnetite, hematite, silica, aluminum, titania and the like. The content of the fine particles in the coated layer is preferably 2 parts by mass or more and 80 parts by mass or less based on the 100 parts by mass of the coated resin. The fine particles preferably have a peak particle diameter of 100 nm or more and 1200 nm or less based on the number distribution in order to improve the contact with the toner and achieve a spacer effect. More preferably, the fine particles have a peak particle diameter of 250 nm or more and 600 nm or less.

In addition, the coated resin layer may be incorporated with conductive fine particles. The conductive fine particles contained in the resin coating the carrier core have a specific resistance of preferably from $1.0\times10^{-2}$ Ω·cm or more to $1.0\times10^{8}$ Ω·cm or less and more preferably from $1.0\times10^{2}$ Ω·cm or more and $1.0\times10^{6}$ Ω·cm or less. The conductive fine particles include carbon black fine particles, graphite fine particles, zinc oxide fine particles and tin oxide fine particles, and especially preferred are carbon black fine particles. Since carbon black fine particles have a high conductivity, they are capable of arbitrarily controlling the specific resistance of an electrophotographic carrier. The content of the conductive fine particles in the coated layer is preferably 2 parts by mass or more and 30 parts by mass or less based on 100 parts by mass of the coated resin. The conductive fine particles preferably have a peak particle diameter of 30 nm or more and 100 nm or less based on the number distribution. If the conductive fine particles have a peak particle diameter within the above range, the toner is capable of improving the developing property by removing the counter charge after developing and of suppressing the attenuation of the toner charging amount after being allowed to stand.

A method for coating the copolymer onto the carrier core surface is not particularly limited and a well-known method may be used. For example, there may be mentioned a so-called immersion method in which a solvent is evaporated while stirring the magnetic carrier core and a coating resin solution, followed by coating the coating resin on the magnetic carrier core surface. Specifically, there may be mentioned a universal mixing stirrer (manufactured by Fuji Paudal Co., Ltd.), a Nauta mixer (manufactured by Hosokawa Micron Co., Ltd.) and the like. In addition, there is a method of spraying a coating resin solution from a spray nozzle while forming a fluid layer to coat the coating resin on the magnetic carrier core surface. Specifically, there may be mentioned Spira coater (manufactured by Okada Seiko Co., Ltd.) and Spiraflow (manufactured by Freund Corporation). Further, there is a method of coating a coating resin in a particle state on a magnetic carrier core with a dry system. Specifically, there may be mentioned a processing method using an apparatus such as a hybridizer (manufactured by Nara Machinery Co., Ltd.), Mechanofusion system (manufactured by Hosokawa Micron Co., Ltd.), High Flex Grar (manufactured by Fukae Powtec Co., Ltd.), Theta-Composer (manufactured by Tokujyu Corporation) and the like.

Figure 3:
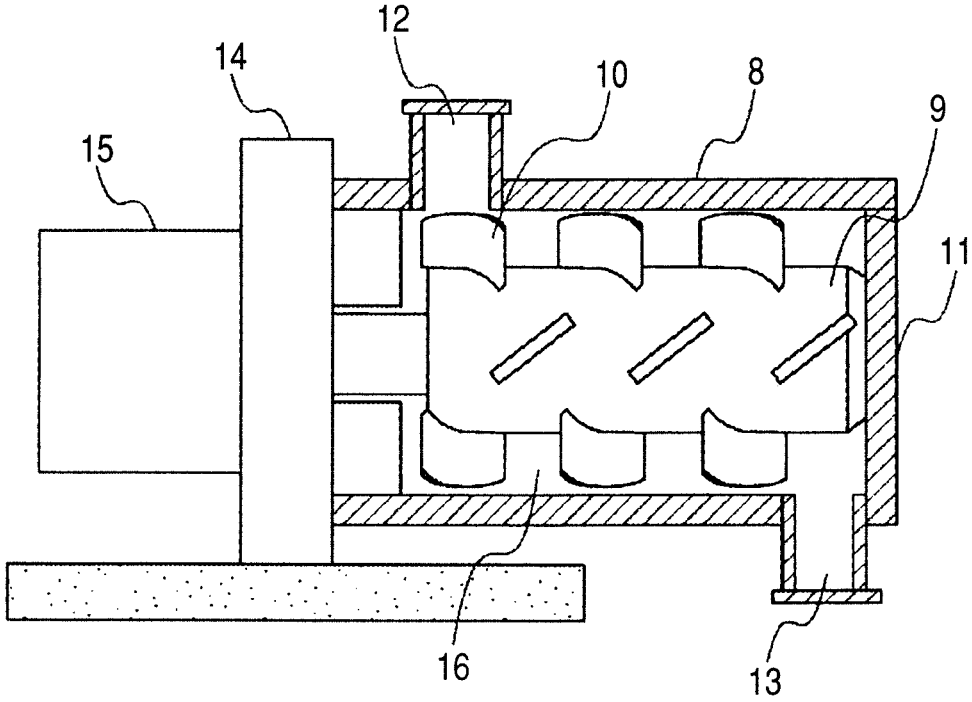
FIG. 3 is a schematic cross-sectional view illustrating an example a coding apparatus used in the production method of a carrier of the present invention.

Among these, in order to efficiently form a more uniform and stronger coating layer, it is more preferable to use an apparatus shown in FIG. 3.

According to the schematic view of the dry coating apparatus shown in FIG. 3, a dry coating technique will be described. Firstly, a processed material having a carrier core and a resin composition for coating is fed from a feed inlet 12. The core carrier and the resin composition for coating may be fed separately, or may be blended with a mixer or a mill before feeding. Next, the processed material is subjected to coating treatment in the small space between a casing 8 and a stirring blade 10 disposed on the surface of a rotation body 9 while stirring and mixing with a stirring blade 10 disposed on the surface of the rotating body 9, followed discharging by a discharge outlet 13. At this time, when viewed from the direction orthogonal to the axis direction of the rotation axis, each end position of the plural stirring members in the direction parallel to the axis direction of the rotation axis is preferably located more inside of the other stirring members than the end position of the adjacent other stirring members. A stirring blade 10*a* on the surface of rotation body 9 has a feeding and stirring mechanism for transferring the processed material to the axis direction of the rotation body 9 (the feed inlet 12 to the discharge outlet 13), and a stirring blade 10*b* has a returning and stirring mechanism for feeding the processed material in the opposite direction (the discharge outlet 13 to the feed inlet 12) at the axis direction of the rotation body 9. By the action of the stirring blades, a uniform and strong stirring force for the processed material may be obtained and the coating of the resin composition on the carrier surface may be performed uniformly and rapidly. Further, the coagulation between carrier particles may be prevented.

In addition, as the positional relation of the stirring blade 10 disposed on the surface of the rotation body 9, the stirring blade 10 is preferably located as the following example. For example, the stirring blade 10*a* is preferably arranged such that at a position in the axis direction, the end position at the side of the feed inlet 12 is overlapped with the end position at the side of the discharge outlet 13 of the adjacent other stirring blade 10*b* at the side of the feed inlet 12. That is, in FIG. 4A, when a line is drawn in the vertical direction from the end position of the stirring blade 10*a*, the adjacent stirring blade 10*a* and the stirring blade 10*b* are overlapped by the width of f. The positional relation is the same in the other stirring blade 10*b*. If the above positional relation is maintained between the stirring blade 10*a* and the stirring blade 10*b*, the processed material is easily transferred from the end position of the stirring blade 10*a* to the end position of the stirring blade 10*b*, and the feeding and returning of the processed material may be carried out effectively with the rotation of the rotation body 9. The width of f is preferably 2 mm or more and 10 mm or less, depending on the diameter of the rotation body.

If the positional relation of the stirring members is maintained, the processed material in the casing which is stirred by the stirring members is fed inside the other adjacent stirring members from the end position of the stirring members, and the action of feeding and returning is suitably carried out, thereby enabling to strongly transfer the force of the stirring members to the processed material. Therefore, while taking advantage of an apparatus of rotary blade type, a stirring effect can be increased by imparting a nonconventional force to a carrier core.

Figure 4A:
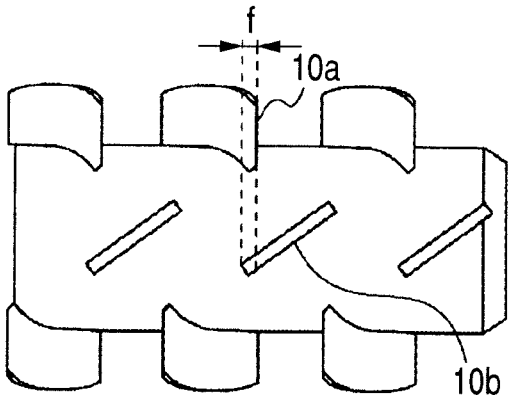
FIGS. 4A, 4B, 4C and 4D are pattern diagrams representing a structure of a stirring blade in the coding apparatus shown in FIG. 3.
Figure 4C:
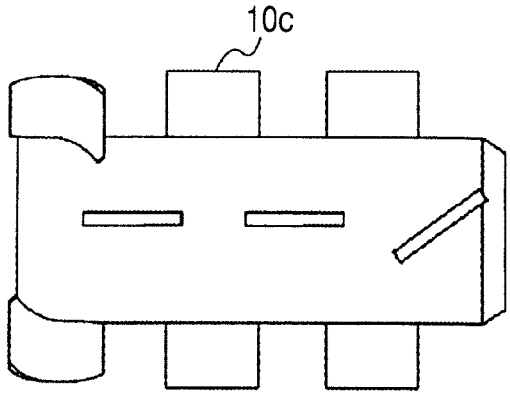
Figure 4B:
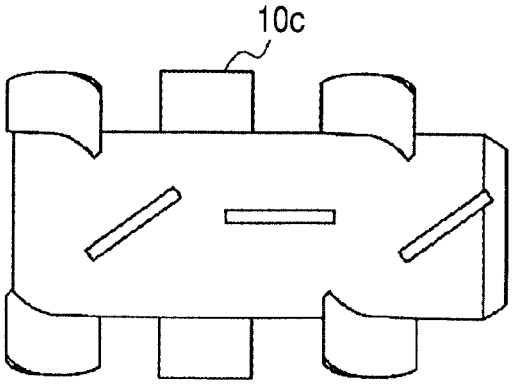
Figure 4D:
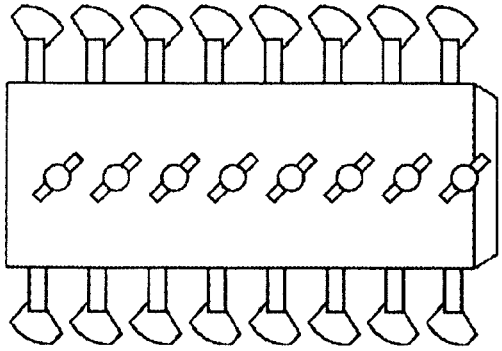

Further, as the shape of the stirring blade 10, there may be used one shown in FIGS. 4A to 4D. As shown in FIG. 4A, there may be disposed a stirring blade 10*c* in the same direction as the axis direction of the rotation body as shown in FIGS. 4B and 4C, in addition to the feeding and returning stirring blade such as the stirring blade 10*a* or 10*b*. In addition, as shown in FIG. 4D, the shape of the stirring blade 10 may be a paddle shape. Further, the angle of the stirring blade may be arbitrarily controlled depending on the particle diameter, true density and flowability of the processed material.

Further, the filling rate of the processed material in a space 16 between a casing 8 and the rotation body 9 during the coating treatment is more preferably 35% by volume or more and 98% by volume or less in order to form an efficient and strong coated layer.

In addition, it is preferable to control the temperature T (° C.) of the processed material in the space 16 between the casing 8 and the rotation body 9 during the coating treatment to a temperature in a range satisfying the following equation.

$$T \leq Tg+20$$

(Tg: The glass transition temperature (° C.) of a resin component contained in the resin composition)

Further, the temperature T of the processed material during the coating treatment is the maximum temperature in measuring the thermal history by mounting a thermocouple on the inner wall surface of the casing 8 and is an atmospheric temperature in the casing during the coating treatment.

Next, the carrier core is explained.

For the carrier core, there may be used well-known magnetic particles such as magnetite particles, ferrite particles, magnetic material dispersion-type resin particles and the like. Among these, preferred are those in which a resin is incorporated in the space of magnetic material dispersion-type resin particles, ferrite particles with a hollow shape or a porous shape, or ferrite particles with these shapes because the true density of the carrier may be reduced. As the resin incorporated in the space of ferrite particles, there may be used a copolymer resin, which is also used as a coating resin. In addition to this, well-known resins may be used and among them, preferred are thermosetting resins. If the true density of the carrier is reduced, a stress to the toner may be reduced and the occurrence of the toner spent may be prevented. In addition, dot reproducibility may be improved and highly accurate images may be obtained.

When the packed apparent density is defined as $\rho 1$ (g/cm$^3$) and the true density as $\rho 2$ (g/cm$^3$), the ferrite particles with a hollow shape or a porous shape preferably has $\rho 1$ of 0.80 or more and 2.40 or less and has a ratio of $\rho 1$ to $\rho 2$ of 0.20 or more and 0.42 or less. The particles having a significantly small ratio of the apparent density to the true density are considered to have many spaces inside the particles. The particles having such a structure provide an excellent developing property because the charge flow is moderately restricted by the presence of the space.

In order to obtain the ferrite particles with a hollow shape or a porous shape, there may be mentioned a method of controlling the growth rate of a crystal by adjusting the temperature in sintering to a slightly lower and a method of forming a hole by incorporation of a foaming agent or a hole-forming agent of organic fine particles. In addition, a carrier excellent in developing property may be obtained by controlling atmosphere in sintering to a low oxygen concentration and controlling the resistance of the carrier core.

There may be used as a carrier core a product obtained by filling a resin component different from a coating resin in the space inside the ferrite particles with a hollow shape or a porous shape. As the resin component to be filled, preferred is one having a high wetting property to the ferrite component and there may be used either a thermoplastic resin or a thermosetting resin. The coating may be performed by coating a polymer resin of the present invention on the particles in a cured state, preferably by using a thermosetting resin without exposure of the filled resin during the coating treatment to the surface. Above all, when using a resin component having a high wetting property, the filling of the space may be easily performed.

As the thermoplastic resin, preferred is a copolymer used as a coating resin, and in addition to that, there may be mentioned, for example, an aromatic polyester resin such as polystyrene, polymethylmethacrylate, styrene-acrylic acid ester copolymer, styrene-methacrylic acid ester copolymer, styrene-butadiene copolymer, ethylene-vinyl acetate copolymer, polyvinyl chloride, polyvinyl acetate, polyvinylidene fluoride resin, fluorocarbon resin, perfluorocarbon resin, solvent-soluble perfluorocarbon resin, polyvinyl pyrrolidone, petroleum resin, novolac resin, saturated alkylpolyester resin, polyethylene terephthalate, polybutylene terephthalate and polyallylate, a polyamide resin, a polyacetal resin, a polycarbonate resin, a polyether sulfon resin, a polysulfon resin, a polyphenylene sulfide resin and a polyether ketone resin.

The thermosetting resin includes, for example, phenol resin, modified phenol resin, maleic resin, alkyd resin, epoxy resin, acrylic resin, unsaturated polyester obtained by polycondensation of anhydrous maleic acid, terephthalic acid and polyhydric alcohol, urea resin, melamine resin, urea-melamine resin, xylene resin, toluene resin, guanamine resin, melamine-guanamine resin, acetoguanamine resin, glyptal resin, furan resin, silicone resin, polyimide resin, polyamide-imide resin, polyetherimide resin and polyurethane resin.

Among the above resins, especially preferred is a silicone resin. As the silicone resin, a conventionally known silicone resin may be used. Specifically, there may be mentioned a straight silicone resin comprising only an organosiloxane bond and a silicone resin obtained by modifying the straight silicone resin with alkyd, polyester, epoxy, urethane and the like.

As a method of filling a resin component in the space of the ferrite particles with a hollow shape or a porous shape, there may be mentioned a method in which the resin component is diluted with a solvent and followed by adding porous magnetic core particles in the diluted solution. The solvent used here may be one capable of dissolving each resin component. In the case of a resin soluble in an organic solvent, there may be used an organic solvent such as toluene, xylene, cellosolve butyl acetate, methyl ethyl ketone, methyl isobutyl ketone, and methanol. In the case of a water-soluble resin component or a resin component of emulsion type, water may be used. As a method of adding the resin component diluted with a solvent inside the porous magnetic core particles, there may be mentioned a method of impregnating the resin component by an application method such as a dipping method, a spray method, a brush coating method, a fluidized bed method and a kneading method and followed by volatilizing the solvent. In case of filling a thermosetting resin, after the solvent is volatilized, the curing reaction is carried out by raising the temperature to a temperature where the resin used is cured and then the coating treatment is preferably performed.

On the other hand, as a specific method for producing magnetic material dispersion-type resin particles, there may be mentioned, for example, a method of kneading a magnetic material of submicron size such as iron powders, magnetite particles and ferrite particles so that it is dispersed in a thermoplastic resin and then pulverizing the resulting magnetic material to a desired carrier particle diameter and followed by subjecting to a thermal or mechanical spheronization treatment to obtain magnetic material dispersion-type resin particles. In addition, magnetic material dispersion-type resin particles may be produced by dispersing the magnetic material in a monomer and then forming a resin by polymerizing the monomer. The resin in this case includes a resin such as vinyl resin, polyester resin, epoxy resin, phenol resin, urea resin, polyurethane resin, polyimide resin, cellulose resin, silicone resin, acrylic resin and polyether resin. The resin may be one or a mixture of two or more of the resins. A phenol resin is especially preferable in view of increasing the strength of a carrier core. The true density and specific resistance may be adjusted by adjusting the amount of the magnetic material. Specifically, in case of magnetic material particles, the magnetic material is preferably added in an amount of 70% by mass or more and 95% by mass or less, relative to the carrier.

The magnetic carrier core has preferably a 50% particle diameter (D50) on a volume basis of 18 μm or more and 98 μm or less from the viewpoint that the coating resin may be uniformly coated, carrier adhesion is prevented and the density of the developer magnetic brush is appropriately adjusted to obtain an image of high image quality. In addition, the magnetic carrier has preferably a 50% particle diameter (D50) on a volume basis of 20 μm or more and 100 μm or less.

The magnetic carrier core has preferably a specific resistance value of $1.0\times10^3$ Ω·cm or more and $1.0\times10^9$ Ω·cm or less at a field strength of 500V/cm. From the viewpoint of improving the developing property, the magnetic carrier core has preferably a specific resistance value of $1.0\times10^5$ Ω·cm to $5.0\times10^7$ Ω·cm or less. If the magnetic carrier core has a specific resistance value within the above range, leak may be prevented without increasing the coating amount of a resin. In addition, a good developing property may be obtained even at a lower field strength.

Further, the specific resistance value of the carrier core may be adjusted by adjusting the specific resistance of a magnetic material incorporated such as ferrite and the like or changing the amount of a magnetic material incorporated.

Subsequently, the magnetic carrier is explained.

The magnetic carrier has a magnetization intensity of preferably 40 $Am^2/kg$ or more and 70 $Am^2/kg$ or less, more preferably 45 $Am^2/kg$ or more and 65 $Am^2/kg$ or less and further more preferably 45 $Am^2/kg$ or more and 62 $Am^2/kg$ or less, under a magnetic field of 1000/4π (kA/m). When the magnetic carrier has a magnetization intensity within the above range, since the magnetic constraint force on a developing sleeve is moderate, the occurrence of carrier adhesion may be more preferably prevented. In addition, the stress imparted to the toner in the magnetic brush may be reduced, thereby enabling to preferably suppress the deterioration of the toner or toner adhesion to other members. Further, the magnetization intensity of the magnetic carrier may be arbitrarily adjusted by the amount of the resin incorporated.

In addition, the carrier has a residual magnetization of preferably 20.0 $Am^2/kg$ or less and more preferably 5.0 $Am^2/kg$ or less. Further, the carrier has a coercive force of preferably 20.0 kA/m or less and more preferably 18.0 kA/m or less. When the carrier has a residual magnetization and a coercive force within the above range, especially preferable flowability is obtained as a developer and good dot reproducibility may, be obtained.

The magnetic carrier has a true density of preferably 2.5 $g/cm^3$ or more and 4.2 $g/cm^3$ or less and more preferably 3.2 $kg/cm^3$ or more and 4.0 $g/cm^3$ or less. A two-components developer containing a carrier having a true density within the above range imposes less load applied to the toner and thus the occurrence of the toner spent is prevented. In addition, in order to obtain a good developing property and prevent the carrier adhesion at a lower field strength, the carrier preferably has a true density within the above range.

The magnetic carrier has preferably a 50% particle diameter (D50) on a volume basis of 20 μm or more and 100 μm or less from the viewpoint of the triboelectric charge imparting property to the toner, the prevention of carrier adhesion to the image region and the achievement of higher quality image. The magnetic carrier has more preferably a 50% particle diameter (D50) on a volume base of from 25 μm or more to 70 μm.

<Toner>

Next, a toner incorporated in the two-components developer together with the magnetic carrier is explained.

The toner has preferably a weight average particle diameter (D4) of 3.0 μm or more and 8.0 μm or less in order to achieve both a high quality image and durability. When the toner has a weight average particle diameter (D4) within the above range, the flowability of the toner is preferable and a sufficient charging amount is easily obtained as well as good resolution is easily obtained.

The toner has preferably an average circularity of 0.94 or more and 1.00 or less. When the toner has an average circularity within the above range, the releasing property between the carrier and the toner is improved. In addition, a good cleaning property is easily obtained. Further, the average circularity is based on the circularity distribution analyzed by sorting the circularity of a toner measured by a flow type particle image analyzer to a channel in which the circularity range of 0.20 to 1.00 are divided into 800 sections. As the flow type particle image analyzer, there was used an apparatus having a view field of 512 pixels×512 pixels and a resolution of 0.37 μm×0.37 μm per pixel.

By the combination use of a toner having a weight average particle diameter within the above range and an average circularity within the above range and a carrier coated with a coating resin of the present invention, the flowability as a developer may be appropriately controlled. As a result, the transferring performance of a two-components developer on an developer supporter is improved and the toner is easily separated from the carrier, thereby enabling to obtain excellent developing property. When in use with a toner having a large particle diameter and a high circularity, since the releasing property between the toner and the carrier becomes too high, the developer is slipped on the developer supporter, thereby tending to cause insufficient transfer of the developer. In addition, when in use with a toner having a small particle diameter and a low circularity, since the adhesion strength between the toner and the carrier is too high, the developing property may be decreased even if the polymer of the present invention is used.

In addition, as the toner, one having toner particles containing a binder resin and a colorant is used.

The binder resin incorporated in the toner particles includes, for example, polyester, polystyrene; a polymer of a styrene derivative such as poly-p-chlorostyrene and polyvinyltoluene; a styrene copolymer such as styrene-p-chlorostyrene copolymer, styrene-vinyltoluene copolymer, styrene-vinylnaphthalene copolymer, styrene-acrylic acid ester copolymer, styrene-methacrylic acid ester copolymer, styrene-α-methyl chloromethacrylate copolymer, styrene-acrylonitrile copolymer, styrene-vinyl methyl ketone copolymer, styrene-butadiene copolymer, styrene-isoprene copolymer and styrene-acrylonitrile-indene copolymer; polyvinyl chloride, phenol resin, modified phenol resin, maleic resin, acrylic resin, methacrylic resin, polyvinyl acetate, silicone resin; a polyester resin having, as a constituent unit, a monomer selected from an aliphatic polyhydric alcohol, an aliphatic dicarboxylic acid, an aromatic dicarboxylic acid, aromatic dialcohols and diphenols; polyurethane resin, polyamide resin, polyvinyl butyral, terpene resin, coumarone-indene resin and petroleum resin.

The toner may be one produced by a pulverization method or one produced by a suspension polymerization method or an emulsification agglomeration method in which toner particles are produced in an aqueous medium.

In order to obtain a toner having a high average circularity, it is preferable to use a method such as a suspension polymerization method or an emulsification agglomeration method in which toner particles are produced in an aqueous medium.

As the polymerizable monomer which may be used in carrying out the suspension polymerization, there may be mentioned, for example, a styrenic monomer, acrylic monomer, a methacrylic monomer, a monomer of ethylene unsaturated monoolefins, a monomer of vinylesters, a monomer of vinylethers, a monomer of vinyl ketones, a monomer of an N-vinyl compound and other vinyl monomers.

The styrenic monomer includes, for example, styrene, o-methylstyrene, m-methylstyrene, p-methylstyrene, p-methoxystyrene, p-phenylstyrene, p-chlorostyrene, 3,4-dichlorostyrene, p-ethylstyrene, 2,4-dimethylstyrene, p-n-butylstyrene, p-tert-butylstyrene, p-n-hexylstyrene, p-n-octylstyrene, p-n-nonylstyrene, p-n-decylstyrene and p-n-dodecylstyrene.

The acrylic monomer includes, for example, acrylic acid esters such as methyl acrylate, ethyl acrylate, n-butyl acrylate, isobutyl acrylate, propyl acrylate, n-octyl acrylate, dodecyl acrylate, 2-ethylhexyl acrylate, stearyl acrylate, dimethylaminoethyl acrylate and phenyl acrylate; acrylic acid; and acrylic acid amides.

In addition, the methacrylic monomer includes, for example, methacrylic acid esters such as ethyl methacrylate, propyl methacrylate, n-butyl methacrylate, isobutyl methacrylate, n-octyl methacrylate, dodecyl methacrylate, 2-ethylhexyl methacrylate, stearyl methacrylate, phenyl methacrylate, dimethylaminoethyl methacrylate, diethylaminoethyl methacrylate; methacrylic acids; and methacrylic acid amides.

The monomer of ethylene unsaturated monoolefins includes, for example, ethylene, propylene, butylenes and isobutylene.

The monomer of vinylesters includes, for example, vinyl acetate, vinyl propionate and vinyl benzoate.

The monomer of vinylethers includes, for example, vinyl methyl ether, vinyl ethyl ether and vinyl isobutyl ether.

The monomer of vinyl ketones includes, for example, vinyl methyl ketone, vinyl hexyl ketone and methyl isopropenyl ketone.

The monomer of an N-vinyl compound includes, for example, N-vinylpyrrole, N-vinylcarbazole, N-vinylindole and N-vinylpyrrolidone.

The other vinyl monomers include, for example, vinylnaphthalenes and an acrylic acid derivative or a methacrylic acid derivative such as acrylonitrile, methacrylonitrile and acrylamide.

These vinyl monomers may be used alone or in combination with two or more kinds.

As the polymerization initiator which is used in producing a vinyl resin, there may be mentioned, for example, an azo or diazo polymerization initiator such as 2,2'-azobis-(2,4-dimethylvaleronitrile), 2,2'-azobisisobutyronitrile, 1,1'-azobis (cyclohexane-1-carbonitrile), 2,2'-azobis-4-methoxy-2,4-dimethylvaleronitrile and azobisisobutyronitrile; a peroxide polymerization initiator or an initiator having a peroxide on the side chain such as benzoyl peroxide, methylethylketone peroxide, diisopropyl peroxycarbonate, cumene hydroperoxide, t-butylhydroxy peroxide, di-t-butylperoxide, dicumylperoxide, 2,4-dichlorobenzoyl peroxide, lauroylperoxide, 2,2-bis(4,4-t-butylperoxycyclohexyl)propane, and tris-(t-butylperoxy)triazine; persulfates such as potassium persulfate and ammonium persulfate; and hydrogen peroxide.

Further, as the polymerization initiator which is radically polymerizable and has three or more functional groups, there may be mentioned, for example, a radically polymerizable polyfunctional polymerization initiator such as tris(t-butylperoxy)triazine, vinyltris(t-butylperoxy)silane, 2,2-bis(4,4-di-t-butylperoxycyclohexyl)propane, 2,2-bis(4,4-di-t-amylperoxycyclohexyl)propane, 2,2-bis(4,4-di-t-octylperoxycyclohexyl)propane, and 2,2-bis(4,4-di-t-butylperoxycyclohexyl)butane.

In addition, the toner preferably contains a release agent.

The release agent includes, for example, an aliphatic hydrocarbon wax such as low-molecular-weight polyethylene, low-molecular-weight polypropylene, a polyolefin copolymer, a polyolefin wax, a microcrystalline wax, a paraffin wax, and a Fischer-Tropsch wax; an oxide of an aliphatic hydrocarbon wax such as a polyethylene oxide wax or a block copolymers thereof; waxes mainly composed of an aliphatic acid ester such as a carnauba wax, a montanic acid ester wax, and behenyl behenate; and partially or wholly deacidified aliphatic acid esters such as a deacidified carnauba wax.

The preferred release agent includes a hydrocarbon wax and a paraffin wax. The toner has one or two or more endothermic peaks in a temperature range of 30 to 200° C. in the endothermic curve of the toner obtained by differential scanning calorimetry, and a temperature of the highest endothermic peak of the endothermic peaks is preferably in a arrange of 50 to 110° C. When such a release agent is used, the adhesion strength between the toner and the carrier is low, thereby enabling to obtain a toner which is excellent in developing property, low-temperature fixability and durability.

The content of the release agent is preferably 1 parts mass or more and 15 parts by mass or less and more preferably 3 parts by mass or more and 10 parts by mass or less, based on 100 parts by mass of the binder resin. If the content of the release agent is within the above range, a preferable releasing property may be obtained.

In addition, the toner may contain a charge controlling agent. The charge controlling agent includes, for example, an organometallic complex, a metal salt and a chelate compound. The organometallic complex includes, for example, monoazo metal complex, acetylacetone metal complex, hydroxycarboxylic acid metal complex, polycarboxylic acid metal complex and polyol metal complex. In addition to these, there may be mentioned a condensation product of a carboxylic acid derivative or an aromatic compound such as a metal salt of carboxylic acid, a carboxylic acid anhydride and esters. In addition, as the charge controlling agent, there may be used a phenol derivative such as bisphenols and calixarenes. Among these, preferred is a metal compound of an aromatic carboxylic acid from the viewpoint of improving the charge-rising of the toner.

The content of the charge controlling agent is preferably 0.1 parts by mass or more and 10.0 parts by mass or less and more preferably 0.2 parts by mass or more and 5.0 parts by mass or less based on 100 parts by mass of the binder resin. When the charge controlling agent is used within the above range, friction charging can be stably performed in various environments from a high-temperature, high-humidity environment to a low-temperature, low-humidity environment.

The triboelectric charging amount of the toner in the two-components developer is preferably 25 mC/kg or more and 65 mC/kg or less in absolute value. The triboelectric charging amount defined here is a charging amount when a developer prepared so that the toner concentration is 3% by mass or more and 20% by mass or less was placed in a plastic bottle and mixed for 2 minutes with a Turbler mixer or various shakers. If the triboelectric charging amount of the toner is within the above range, an image of high image quality is easily obtained and an image without fogging can be easily obtained.

A colorant incorporated in the toner includes the followings.

A black colorant includes carbon black; a magnetic material; and a colorant toned in black using a yellow colorant, a magenta colorant and a cyan colorant.

In the colorant, a pigment may be used alone, but a dye and a pigment are preferably used in combination from the viewpoint of the improved sharpness of the image quality of a full color image.

A coloring pigment for a magenta toner includes C.I. Pigment Red 1, 2, 3, 4, 5, 6, 7, 8, 9, 10, 11, 12, 13, 14, 15, 16, 17, 18, 19, 21, 22, 23, 30, 31, 32, 37, 38, 39, 40, 41, 48, 49, 50, 51, 52, 53, 54, 55, 57, 58, 60, 63, 64, 68, 81, 83, 87, 88, 89, 90, 112, 114, 122, 123, 163, 202, 206, 207, 209 and 238; C.I. Pigment Violet 19; and C.I. Vat Red 1, 2, 10, 13, 15, 23, 29 and 35.

A dye for the magenta toner includes C.I. Solvent Red 1, 3, 8, 23, 24, 25, 27, 30, 49, 81, 82, 83, 84, 100, 109 and 121; C.I. Disperse Red 9; C.I. Solvent Violet 8, 13, 14, 21, 27; an oil-soluble dye such as C.I. Disperse Violet 1; C.I. Basic Red 1, 2, 9, 12, 13, 14, 15, 17, 18, 22, 23, 24, 27, 29, 32, 34, 35, 36, 37, 38, 39 and 40; and a basic dye such as C.I. Basic Violet 1, 3, 7, 10, 14, 15, 21, 25, 26, 27 and 28.

A coloring pigment for a cyan toner includes C.I. Pigment Blue 2, 3, 15, 15:3, 15:4, 16 and 17; C.I. Vat Blue 6; C.I. Acid Blue 45; and a copper phthalocyanine pigment in which 1 to 5 phthalimidomethyl groups are substituted with a phthalocyanine skeleton.

A yellow coloring pigment includes C.I. Pigment Yellow 1, 2, 3, 4, 5, 6, 7, 10, 11, 12, 13, 14, 15, 16, 17, 23, 62, 65, 73, 74, 83, 93, 94, 95, 97, 109, 110, 111, 120, 127, 128, 129, 147, 151, 154, 155, 168, 174, 175, 176, 180, 181 and 185; and C.I. Vat Yellow 1, 3 and 20.

A coloring dye for yellow includes C.I. Solvent Yellow 162.

The use amount of the colorant is preferably from 0.1 to 30 parts by mass, more preferably from 0.5 to 20 parts by mass and most preferably from 3 to 15 parts by mass based on 100 parts by mass of the binder resin.

As spacer particles for increasing the releasing property between the toner and the carrier, inorganic particles are preferably externally added to the toner. The inorganic particles have at least one or more maximum values in a range of 80 nm or more and 200 nm or less in the particle size distribution based on the number distribution. In order to suitably suppress the detachment of the inorganic particles from the toner while allowing the inorganic particles to function as spacer particles, it is preferable to externally add inorganic particles having at least one maximum values in a range of from 100 nm or more to 150 nm. The inorganic particles preferably contain silica, titanium oxide, aluminum, cerium oxide and strontium titanate.

Further, for the purpose of improving flowability and transferability, the other organic fine particles may be added to the toner. The inorganic fine particles externally added on the toner particle surface preferably contains titanium oxide, aluminum and silica. It is preferable to incorporate inorganic fine particles having at least one or more maximum values in a range of 10 nm or more and 50 nm or less in the particle size distribution based on the number distribution, and a preferred embodiment is that the inorganic fine particles are used together with the spacer particles.

The total content of the external additives is preferably 0.3 parts by mass or more and 5.0 parts by mass or less and more preferably 0.8 parts by mass or more and 4.0 parts by mass or less, based on 100 parts by mass of the toner particles. Among these, the content of organic particles having at least one or more maximum values in a range of 80 nm or more and 200 nm or less in the particle size distribution based on the number distribution is preferably 0.1 parts by mass or more and 2.5 parts by mass or less and more preferably 0.5 parts by mass or more and 2.0 parts by mass or less. If the content of the organic particles is within the above range, the effect as the spacer particles becomes more prominent.

In addition, the surface of silica particles or inorganic fine particles used as an external additive is preferably subjected to hydrophobic treatment. The hydrophobic treatment is preferably carried out with a coupling agent such as various coupling agents and silane coupling agents; a fatty acid and its metal salt; a silicone oil; or a combination thereof.

The titanium coupling agent includes, for example, tetrabutyl titanate, tetraoctyl titanate, isopropyltriisostearoyl titanate, isopropyltridecylbenzenesulfonyl titanate and bis (dioctylpyrophosphate)oxyacetate titanate.

In addition, the silane coupling agent includes, for example, γ-(2-aminoethyl)aminopropyltrimethoxysilane, γ-(2-aminoethyl)aminopropyldimethoxysilane, γ-methacryloxypropyltrimethoxysilane, N-β-(N-vinylbenzylaminoethyl)-γ-aminopropyltrimethoxysilane hydrochloride, hexamethyldisilazane, methyltrimethoxysilane, butyltrimethoxysilane, isobutyltrimethoxysilane, hexyltrimethoxysilane, octyltrimethoxysilane, decyltrimethoxysilane, dodecyltrimethoxysilane, phenyltrimethoxysilane, o-methylphenyl trimethoxysilane and p-methylphenyl trimethoxysilane.

The fatty acid includes, for example, a long chain fatty acid such as undecyl acid, lauric acid, tridecyl acid, dodecyl acid, myristic acid, palmitic acid, pentadecyl acid, stearic acid, heptadecyl acid, arachic acid, montan acid, oleic acid, linoleic acid and arachidonic acid. The metal for the metal salt of the fatty acids includes, for example, zinc, iron, magnesium, aluminum, calcium, sodium and lithium.

The silicone oil includes, for example, a dimethyl silicone oil, a methylphenyl silicone and an amino-modified silicone oil.

The hydrophobic treatment is preferably performed by adding 1 to 30% by mass (more preferably 3% by mass or more and 7% by mass or less) of the hydrophobic treatment agents to the treated particles to coat the treated particles.

The hydrophobicity degree of the external additive subjected to hydrophobic treatment is not particularly limited, but for example, the hydrophobicity degree after the hydrophobic treatment is preferably 60 or more and 92 or less. The hydrophobicity degree indicates a wetting property to methanol and is an indicator of hydrophobicity.

Methods for measuring various physical properties of the magnetic carrier and toner are described below.

<Method for Separating Carrier Core from Magnetic Carrier>

Into a beaker containing 50 ml of toluene was added 10 g of a carrier, and the resultant mixture was subjected to dispersion treatment for two minutes using a desk-top type ultrasonic washer disperser "VS-150" (manufactured by Velvo-Clear Co., Ltd.) at an oscillation frequency of 50 kHz and electric output of 150 W. Thereafter, the supernatant was removed while fixing the carrier core by a magnet so that the carrier core was not washed away. This operation was repeated five times and then the resultant mixture was dried at 50° C. for 24 hours using a dryer under a nitrogen flow to obtain a carrier core.

<Specific Resistance of Carrier and Carrier Core>

Figure 1B:
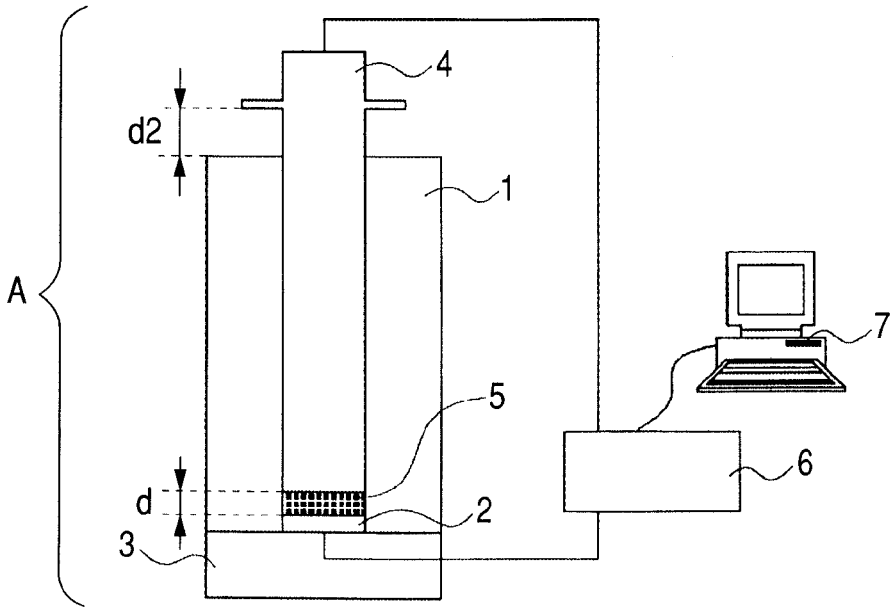

The specific resistance of the carrier and the carrier core is measured by a measuring apparatus summarized in FIGS. 1A and 1B. In addition, the specific resistance of the carrier core is measured using a sample before being coated with a resin.

A resistance measuring cell A is comprised of a cylindrical PTFE resin container 1 having a hole with a cross-sectional area of 2.4 $cm^2$, a lower electrode 2 (made of stainless steel), a supporting seat 3 (made of PTFE) and a upper electrode 4 (made of stainless steel). The thickness of a sample is measured by mounting the cylindrical PTFE resin container 1 on the supporting seat 3, filling approximately 0.7 g of the sample (carrier or carrier core) 5 and placing the upper electrode 4 on the filled sample 5. If the thickness when a sample is not present is determined by d1 (blank), the actual thickness when approximately 0.7 g of a sample is filled is determined by d and the thickness when a sample is filled is determined by d2 (sample), the sample thickness d is represented by the following equation.

$$d = d2\ (\text{sample}) - d1\ (\text{blank})$$

The specific resistance of a magnetic material core can be determined by measuring a current flowing when a voltage is applied between the electrodes. The measurement is made by using an electrometer 6 (Keithley 6517, manufactured by Keithley Instruments Inc.) and a computer 7 for control.

The measurement conditions are such that the contact area S between the magnetic material core and the electrode is 2.4 $cm^2$ and the load of the upper electrode is 120 g.

For the application conditions of the voltage, the electrometer itself determines whether the application of the maximum of 1000 V is possible (the range not exceeding the current limiter) using the internal program of the electrometer, thereby automatically determining the maximum value of the applied voltage. The current value is measured after maintaining for 30 seconds as the step of the voltage obtained by dividing the maximum voltage value into five. For example, when the maximum applied voltage is 1000 V, 1000 V, 800 V, 600 V, 400 V and 200 V are applied and the current value is measured after maintaining for 30 seconds at each step. The electric field strength and the specific resistance are calculated by processing the current value with the computer and then are plotted on a graph. In addition, the specific resistance and the electric field strength may be determined by the following equations.

$$\text{Specific Resistance } (\Omega\cdot\text{cm}) = (\text{The applied voltage (V)}/\text{The measured current } (A)) \times S(\text{cm}^2)/d(\text{cm})$$

$$\text{Electric Field Strength (V/cm)} = \text{The applied voltage (V)}/d(\text{cm})$$

Figure 2A:
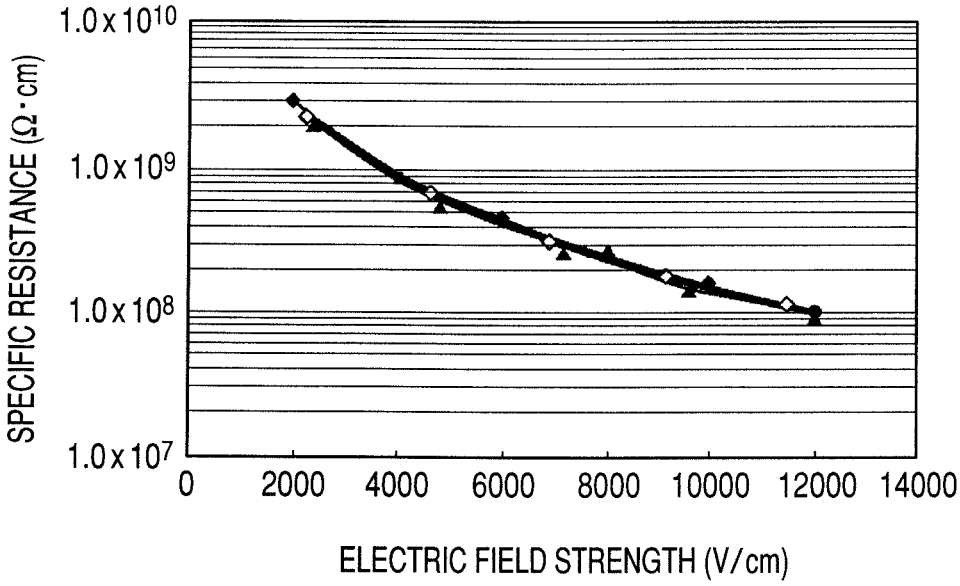
FIGS. 2A and 2B are examples of a graph showing the measurement results of specific resistance measured by an apparatus shown in FIGS. 1A and 1B.

FIG. 2A shows the plotted results of the carrier H produced in Example. In addition, FIG. 2B shows the plotted results of the carrier P.

Figure 2B:
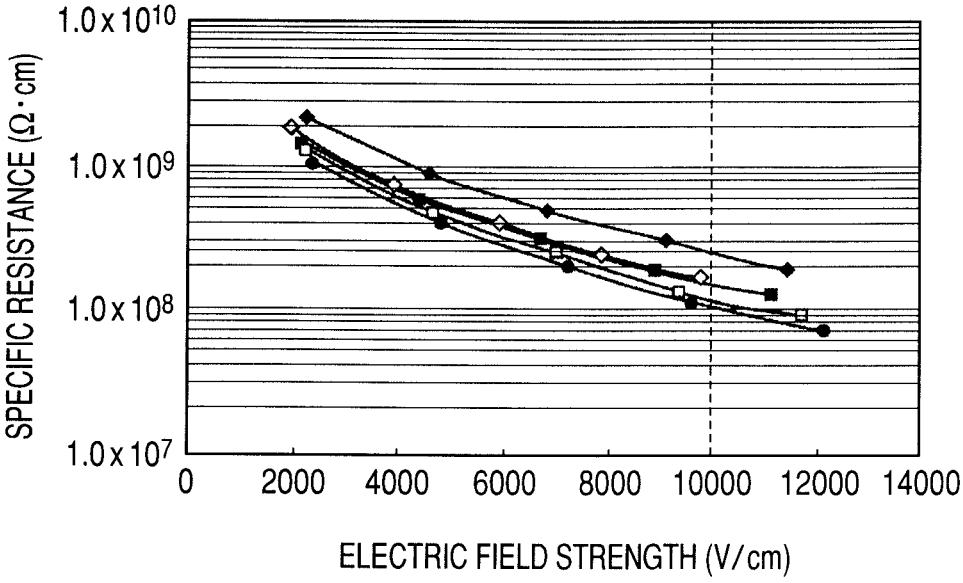

FIGS. 2A and 2B show the results measured by the above methods after preparing five samples relating to each carrier. The specific resistance at 10000 V/cm of a carrier is read out from the specific resistance at 10000 V/cm on the graph. The specific resistance value at 10000 V/cm is determined by the intersecting point of the vertical line of 10000 V/cm and the line of the measured specific resistance on the graph. In addition, when the intersecting point is not present, the specific resistance value of the carrier at 10000 V/cm is determined by the intersecting point of the vertical line of 10000 V/cm and the line obtained by extrapolating the measured point. As described above, the specific resistance of the carrier in the present invention is determined as the arithmetic average value of measurements at five points at 10000 V/cm when five samples are tested.

Further, the difference between the common logarithm value of the maximum value and the common logarithm value of the minimum value of the resulting data at five points are calculated. The value is referred to as "a specific resistance deviation" and in Examples, the value was used to evaluate the coating uniformity of the carrier.

When measuring the specific resistance of the carrier core, it can be determined by reading out the specific resistance at 500 V/cm on the graph in the same manner as the carrier. Specifically, the specific resistance value at 500 V/cm is determined by the intersecting point of the vertical line of 500 V/cm and the line of the measured specific resistance on the graph (not shown, but corresponding to the specific resistance of the carrier). In addition, when the intersecting point is not present, the specific resistance value of the carrier core at 500 V/cm is determined by the intersecting point of the vertical line of 500 V/cm and the line obtained by extrapolating the measured point. Further, the specific resistance of the carrier core is determined as the arithmetic average value of measurements at five points at 500 V/cm when five samples are tested in the same manner as the carrier.

<Measurement of Glass Transition Point (Tg) of Copolymer incorporated in Resin Coated Layer of Magnetic Carrier>

The magnetic carrier was washed with THF (tetrahydrofuran) and 10 mg of a component separated from the magnetic carrier was weighed and used as a measurement sample. In addition, an empty aluminum pan was used as a reference.

The measurement was carried out using differential scanning calorimeter (DSC apparatus) DSC 2920 (manufactured by TA Instruments Inc.) according to ASTM D3418-82.

<Measurement of Peak Particle Size based on the Number Distribution of Fine Particles and External Additive of Toner incorporated in Resin Coated Layer of Magnetic Carrier>

The peak particle size based on the number distribution of fine particles incorporated in the resin coated layer of the magnetic carrier was measured by the following procedure.

A component, which is separated from the magnetic carrier by washing a carrier having a resin coated layer with a solvent (for example, toluene) capable dissolving a resin forming the resin coated layer, is observed using a scanning electron microscope (SEM) with a magnification of 50000 times. And, 500 pieces or more fine particles having a particle diameter of 5 nm or more are extracted at random. The long and short axes of the extracted particles are measured by a digitizer, and the average value of the long and short axes is defined as a particle diameter of the fine particles. By examining the distribution of the particle diameters of 500 pieces or more of the extracted fine particles (using a histogram of a column in which a column width is sectioned every 10 nm such as 5 to 15 nm, 15 to 25 nm, 25 to 35 nm, . . . , and the like), a histogram is drawn with a particle diameter of the center value in the column. From the histogram, it is evaluated whether the particle diameter which becomes the maximum is in a range of 80 nm or more and 200 nm or less. In the histogram, the particle diameter which becomes the maximum may be single or plural, and it may or may not be a problem that the peak in a range of 80 nm or more and 200 nm or less has the maximum value.

In addition, the particle diameter of the external additive can be measured in the same manner as the fine particles.

<Method for Measuring Magnetization Intensity of Magnetic Carrier>

The magnetization intensity of a magnetic carrier can be measured by using a vibrating magnetic field-type magnetic property automatic recording apparatus (Vibrating sample magnetometer) or an automatic recording apparatus of direct current magnetization property (B-H Tracer). In Examples described later, the magnetization intensity of a magnetic carrier was measured in the following procedure by using a vibrating magnetic field-type magnetic property automatic recording apparatus, BHV-30 (manufactured by Riken Denshi. Co., Ltd.).

By using a carrier filled in a cylindrical plastic container sufficiently densely as a sample, the magnetizing moment of the carrier in the external magnetic field of $100/4\pi$ (kA/m) was measured. In addition, the actual mass of the carrier filled into the container was measured. From these, the magnetization intensity ($Am^2/kg$), residual magnetization ($Am^2/kg$) and coercive force (kA/m) of the carrier were determined.

<Method for Measuring 50% Particle Diameter (D50) on a Volume Distribution Basis of Carrier and Resin Composition>

The particle size distribution was measured by using a particle size distribution analyzer of a laser diffraction scattering method "Microtrac MT3300EX" (manufactured by Nikkiso Co., Ltd.). The measurement was performed by mounting a sample feeder for dry measurement "one shot dry sample conditioner Turbotrac" (manufactured by Nikkiso Co., Ltd.). The feeding conditions of Turbotrac were set at an air flow of approximately 33 l/sec and a pressure of approximately 17 kPa using a dust collector as a vacuum source. The control of the measurement is performed on a software program. The particle diameter is determined as a 50% particle diameter (D50) which is a cumulative value on a volume distribution basis. The control and analysis are performed by using accessory software (Version 10.3.3-202D).

<Method for Measuring True Density of Magnetic Carrier and Carrier Core>

The true density was measured by using a dry automatic densimeter Autopicnometer (manufactured by Yuasa Ionics Inc.)

<Method for Measuring Packed Apparent Density of Carrier Core> i) In Case of Ferrite Particles Having a Hollow Shape or a Porous Shape

When ferrite particles having a hollow shape or a porous shape can be prepared as a sample, they are used as a measurement sample, and when only a magnetic carrier is available, ferrite particles are taken out by the following method to use as a measurement sample.

10.0 g of a magnetic carrier was prepared and placed into a crucible. The crucible was heated at 900° C. for 16 hours while $N_2$ gas was introduced using a muffle furnace equipped with an $N_2$ gas introduction inlet and an exhaust unit (FP-310, manufactured by Yamato Scientific Co., Ltd.). Thereafter, the crucible was left to stand until the temperature of the magnetic carrier becomes 50° C.

The magnetic carrier after the heating time was placed into a 50 ml polybottle, and 0.2 g of sodium dodecylbenzenesulfonate and 20 g of water are added to the polybottle to wash off soot or the like adhered to the magnetic carrier. At that time, the magnetic carrier was washed by fixing with a magnet to prevent from being washed away. Further, the magnetic carrier was washed with water five times or more so that the alkylbenzene sulfonate did not remain in the magnetic carrier. Thereafter, the magnetic carrier was dried at 60° C. for 24 hours. In the manner mentioned above, ferrite particles were taken out of the magnetic carrier.

By using the ferrite particles taken out in the manner mentioned above, the packed apparent density was measured using a powder tester, PT-R (manufactured by Hosokawa Micron Co., Ltd.).

In the measurement of the packed apparent density, the reciprocal up-and-down tapping of the metal cap was performed with an amplitude of 18 mm 180 times while vibrating with an amplitude of 1 mm and supplying the ferrite particles to exactly 10 ml by using a sieve with an aperture of 500 μm. Thereafter, the packed apparent density ($g/cm^3$) of the ferrite particles was calculated from the mass of the carrier particles after tapping.

ii) In Case of Other than Ferrite Particles Having a Hollow Shape or a Porous Shape When a carrier core may be prepared as a sample, it is used as a measurement sample, and when only a magnetic carrier coated with a resin is available, the coated resin is removed by the following method and the carrier core is taken out to use as a measurement sample.

Into a beaker containing 50 ml of toluene was added 10 g of a magnetic carrier prepared, and the resultant mixture was subjected to dispersion treatment for two minutes using a desk-top type ultrasonic washer disperser "VS-150" (manufactured by Velvo-Clear Co., Ltd.) at an oscillation frequency of 50 kHz and electric output of 150 W. Thereafter, the supernatant containing the dissolved coating resin was removed while fixing the carrier core by a magnet so that the carrier core was not flowed out. This operation was repeated five times or more and the supernatant was confirmed to be transparent. The resultant mixture was then dried at 50° C. for 24 hours using a dryer under a nitrogen flow to obtain a carrier core.

By using the carrier core taken out in the manner mentioned above, the packed apparent density ($g/cm^3$) was measured in the same manner as in the case i).

<Method for Measuring Loose Apparent Density of Carrier Core>

After separating a carrier core in the same manner as in the measurement of the packed apparent density, the measurement of the loose apparent density was performed according to JIS-Z 2504.

<Method for Measuring Weight Average Molecular Weight of Resin>

The weight average molecular weight (Mw) of a resin was measured by gel permeation chromatography (GPC) in the following procedure. The weight average molecular weight of the resin used in the carrier core or the binder resin of the toner can be measured by this measurement procedure.

The measurement is carried out by flowing tetrahydrofuran (THF) at a flow rate of 1 ml/min into a column stabilized in a heat chamber at 40° C. and injecting 50 to 200 μl of a THF sample solution in which a sample resin concentration is adjusted to 0.05 to 0.6% by mass. A refractive index (RI) detector is used as a detector. In order to accurately measure a molecular weight region of $10^3$ to $2\times10^6$, the column used is preferably a combination of multiple commercially available polystyrene gel columns. For example, preferred is a combination of μ-styragel 500, $10^3$, $10^4$, and $10^5$, manufactured by Waters Corporation or a combination of Shodex KA-801, 802, 803, 804, 805, 806, and 807, manufactured by Showa Denko K.K.

In the measurement of the molecular weight, the molecular weight distribution possessed by the sample is calculated from a relationship between a logarithmic value of a calibration curve prepared by several kinds of monodisperse polystyrene standard samples and the number of counts. As the standard polystyrene sample for preparing a calibration curve, there are used samples having a molecular weight of $6\times10^2$, $2.1\times10^3$, $4\times10^3$, $1.75\times10^4$, $5.1\times10^4$, $1.1\times10^5$, $3.9\times10^5$, $8.6\times10^5$, $2\times10^6$ and $4.48\times10^6$, which are produced by Pressure Chemical Co. or by Tosoh Corporation, and at least about ten standard polystyrene samples are appropriately used.

<Method for Measuring Weight Average Particle Diameter (D4) of Toner>

The weight average particle diameter (D4) of the toner was calculated by measuring with 25000 effective measuring channels and analyzing the measurement data using a precise particle size distribution analyzer having a 100 μm aperture tube by a pore electric resistance method "Coulter Counter Multisizer 3" (registered trademark, manufactured by Beckman Coulter, Inc.) and a dedicated software attached "Beckman Coulter Multisizer 3 Version 3.51" (manufactured by Beckman Coulter, Inc.).

As an electrolytic aqueous solution used for the measurement, there may be used an aqueous solution of sodium chloride having a concentration of about 1% by mass which is prepared by dissolving special grade sodium chloride in ion-exchanged water, for example, "ISOTON II" (manufactured by Beckman Coulter, Inc.).

In addition, before the measurement and analysis, the dedicated software was set up as follows.

In the "Change Display of Standard Measurement Method (SOM)" of the dedicated software, the total count number of the control mode is set at 50000 particles, the measurement time is set at 1 and the Kd value is set at a value obtained by using "standard particle of 10.0 μm" (manufactured by Beckman Coulter, Inc.). The threshold value and nozzle level are automatically set by pressing measurement button of the threshold/nozzle. In addition, a check is entered at the flush of the aperture tube after measurement by setting the count at 160 μA, the gain at 2 and the electrolytic aqueous solution at ISOTON II.

In the "Conversion Setting Display from Pulse to Particle Diameter" of the dedicated software, the bin interval is set at the logarithm particle diameter, the particle diameter bin is set at the 256 particle size bin, and the particle size range is set at 2 μm or more and 60 μm or less.

A specific measurement method is as follows.

(1) Into a 250 ml round-bottom glass beaker exclusively used for Multisizer 3 is added approximately 200 ml of the electrolytic aqueous solution and is set at the sample stand, followed by rotating the stirrer rod in an anticlockwise direction at a speed of 24 rpm/s. Thereafter, dirt and air bubbles in the aperture tube are removed in advance by the "flush of aperture" function of the analysis software.

(2) Into a 100 ml flat-bottom glass beaker is added 30 ml of the electrolytic aqueous solution, followed by adding as a dispersant approximately 0.3 ml of a diluted solution obtained by diluting "Contaminon N" (a 10% by weight aqueous solution of a neutral surfactant for washing precision measuring devices which has a pH of 7 and comprises a non-ionic surfactant, an anionic surfactant and an organic builder, produced by Wako Pure Chemical Industries Ltd.) with ion-exchange water.

(3) A predetermined amount of ion-exchange water is added in a water bath of an ultrasonic dispersing machine "Ultrasonic Dispersion System Tetra 150" (manufactured by Nikkaki-Bios Co., Ltd.) at an electric output of 120 W which is embedded with two oscillators at an oscillation frequency of 50 kHz with a phase shifting of 180°, followed by adding approximately 2 ml of the Contaminon N.

(4) The beaker described in the above (2) is set to a fixing hole of the beaker of the ultrasonic dispersing machine and then the ultrasonic dispersing machine is operated. Thereafter, the height position of the beaker is adjusted so that the oscillation state of the electrolytic aqueous solution level in the beaker becomes maximum.

(5) In a state where an ultrasonic wave is irradiated to the electrolytic aqueous solution in the beaker described in the above (4), approximately 10 mg of a toner is dropwise added to the electrolytic aqueous solution to disperse. Thereafter, the ultrasonic dispersion treatment is further continued for 60 seconds. In addition, in carrying out the ultrasonic dispersion, the water temperature in the water bath is arbitrarily controlled so that the temperature is 10° C. or higher and 40° C. or lower.

(6) Into the round-bottom beaker described in the above (1) disposed in the sample stand is dropwise added the electrolytic aqueous solution described in the above (5) in which a toner is dispersed using a pipette to adjust so that the measurement concentration is approximately 5%. Thereafter, the measurement is made until the measuring particles number is 50000 pieces.

(7) The measurement data are analyzed with the dedicated software attached to the apparatus ("Beckman Coulter Multisizer 3 Version 3.51") to calculate the weight average particle diameter (D4). In addition, when the graph/% by volume is set with the dedicated software, an "average diameter" of the analysis/volume statistical value (arithmetic average) display is defined as a weight average particle diameter (D4).

<Method for Measuring Average Circularity of Toner>

The average circularity of a toner can be measured with a flow-type particle image analyzer "FPIA-3000" (manufactured by SYSMEX CORPORATION) under the measurement and analysis conditions at the time of a calibration operation.

The measurement principle of the flow-type particle image analyzer "FPIA-3000" (manufactured by SYSMEX CORPORATION) is that flowing particles are captured as a static image, and the image is analyzed. A sample added to a sample chamber is transferred to a flat sheath flow cell with a sample sucking syringe. The sample transferred to the flat sheath flow cell is sandwiched between sheath liquids to form a flat flow. The sample passing through the inside of the flat sheath flow cell is irradiated with stroboscopic light at an interval of 1/60 second and the flowing particles can be photographed as a static image. In addition, the particles are captured in focus because the flow of the particles is flat. A particle image is captured with a CCD camera, and the captured image is subjected to image processing at an image processing resolution of 512×512 pixels (0.37×0.37 μm per pixel). Thereafter, each particle image is edge detected to measure the projected area, perimeter, and the like of each particle image.

Subsequently, the projected area S and the perimeter L of each particle image are determined. A circle-equivalent diameter and a circularity are determined by using the projected area S and the perimeter L. The circle-equivalent diameter is defined as the diameter of a circle having the same area as that of the projected area of a particle image. The circularity is defined as a value obtained by dividing the perimeter of a circle determined from the circle-equivalent diameter by the perimeter of a particle projected image and is calculated by the following equation.

$$C=2\times(\pi\times S)^{1/2}/L$$

When a particle image is of a circular shape, the circularity is 1.000. The larger the degree of unevenness of the periphery of the particle image, the smaller value of the circularity.

After the circularity of each particle is calculated, the circularity in a range of 0.2 to 1.0 is divided into 800 sections, and the average circularity is calculated by using the number of measured particles.

As a specific measuring method, into 20 ml of ion-exchanged water is added 0.1 ml of a surfactant (preferably alkylbenzene sulfonate) as a dispersant, followed by adding 0.5 g of a measurement sample. Thereafter, the resultant mixture is subjected to dispersing treatment for 2 minutes by using a desktop ultrasonic washing disperser with an oscillation frequency of 50 KHz and electrical output of 150 W ("VS-150", manufactured by Velvo-Clear Co., Ltd.) to prepare a dispersion liquid for measurement. At that time, the dispersion liquid is appropriately cooled so that that the temperature of the dispersion liquid is 10° C. or higher and 40° C. or lower.

The flow-type particle image analyzer mounted with a standard objective lens (at a magnification of 10 times) is used for the measurement, and a particle sheath "PSE-900A" (manufactured by Sysmex Corporation) is used as a sheath liquid. The dispersion liquid prepared in accordance with the procedure is introduced into the flow-type particle image analyzer, and the particle diameters of 30000 particles are measured according to the total count mode in an HPF measuring mode. The average circularity of the toner is determined by setting a binarization threshold at the time of particle analysis to 85% and limiting the particle diameters to be analyzed to a circle-equivalent diameter of 2.00 μm or more and 200.00 μm or less.

Prior to the initiation of the measurement, automatic focusing is performed by using standard latex particles (obtained by diluting a 5200A produced by Duke Scientific Corporation with ion-exchanged water). Thereafter, focusing is preferably performed every two hours from the initiation of the measurement.

In addition, in the present Examples, there was used a flow-type particle image analyzer which has been calibrated by Sysmex Corporation and received a calibration certificate issued by Sysmex Corporation. At that time, the measurement is performed under measurement and analysis conditions at the time of the reception of the calibration certificate except that particle diameters to be analyzed are limited to a circle-equivalent diameter of 2.00 μm or more and 200.00 μm or less.

<Method for Measuring Hydrophobicity Degree of External Additive>

Into a cylindrical glass container with a diameter of 5 cm and a thickness of 1.75 mm is added 70 ml of an aqueous methanol solution comprising 50% by volume of methanol and 50% by volume of water, and then ultrasonic waves are applied for 5 minutes with an ultrasonic disperser in order to remove air bubbles and the like. In addition, in measuring a sample having a high degree of hydrophobicity, the methanol concentration at the time of starting measurement is arbitrarily adjusted.

Subsequently, 0.06 g of a sample is accurately weighed and added in the container in which the aqueous methanol solution is incorporated to prepare a sample solution for measurement.

Thereafter, the sample solution for measurement is set in a wettability testing apparatus "WET-100P" (manufactured by Rhesca Co., Ltd.). The sample solution for measurement is stirred at a speed of 6.7 $s^{-1}$ (400 rpm) with a magnetic stirrer. In addition, as a rotor of the magnetic stirrer, there is used a spindle rotor with a length of 25 mm and a maximum body diameter of 8 mm which is coated with a fluorine resin.

Subsequently, the above apparatus is passed through the sample solution for measurement, and the transmittance is measured with light having a wavelength of 780 nm while dropwise adding methanol at a rate of 1.3 ml/min to prepare a methanol-dropping transmittance curve. The hydrophobicity degree is defined as a methanol concentration (% by volume) when the transmittance is 50% in the resulting methanol-dropping transmittance curve.

EXAMPLES

Hereinafter, the present invention will be more specifically described with reference to the following Examples. However, it should be understood that the present invention is not limited by these examples.

Production of Copolymer 1

Into a four-necked flask, which had a reflex cooler, a thermometer, a nitrogen-introducing pipe and a friction type stirrer, were added 25 parts by mass of a methyl methacrylate macromer (average value n=5) having a weight average molecular weight of 5000 and having an ethylenic unsaturated group (methacryloyl group) at one end which has a structure represented by the following formula (4) and 75 parts by mass of cyclohexyl methacrylate monomer having an ester portion as units of cyclohexyl which is represented by the following formula (5). Further, into the flask were charged 90 parts by mass of toluene, 110 parts by mass of methyl ethyl ketone and 2.0 parts by mass of azobisisovarelonitrile. The resulting mixture was maintained at 70° C. for 10 hours under a nitrogen flow, and after the polymerization reaction, washing was repeated to obtain a graft copolymer solution (solid content 33% by mass). The solution had a weight average molecular weight of 56000 as measured by gel permeation chromatography (GPC) and had a Tg of 91° C. This was used as a copolymer 1. The physical properties of the resulting copolymer 1 are shown in Table 1.

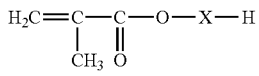

(4)

In the formula, X is represented by the following chemical formula.

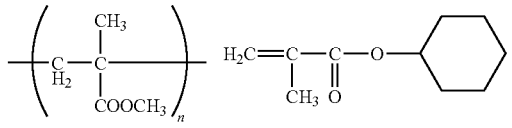

(5)

Production of Copolymer 2

A copolymer 2 was obtained in the same manner as in the production of the copolymer 1 except for using a macromonomer (average value n=50) having a weight average molecular weight of 5000 represented by the following formula (6) instead of a macromonomer represented by the formula (4). The copolymer 2 had a solid content of 33% by mass, a weight average molecular weight of 58000 and a Tg of 95° C. The physical properties of the resulting copolymer 2 are shown in Table 1.

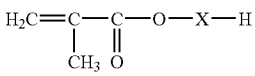

(6)

(In the formula, X is represented by the following chemical formula)

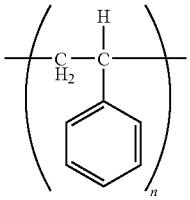

Production of Copolymer 3

A copolymer 3 was obtained in the same manner as in the production of the copolymer 1 except for using 10 parts by mass of isobutyl methacrylate macromonomer (average value n=22) having a weight average molecular weight of 3100 and having a structure represented by the following formula (7) instead of the macromonomer represented by the formula (4), and changing the amount of the cyclohexyl methacrylate monomer represented by the formula (5) to 65 parts by mass and further using 25 parts by mass of a methyl methacrylate monomer. The copolymer 3 had a solid content of 33% by mass, a weight average molecular weight of 52000 and a Tg of 91° C. The physical properties of the resulting copolymer 3 are shown in Table 1.

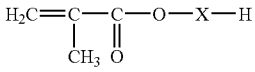

(7)

(In the formula, X is represented by the following chemical formula.)

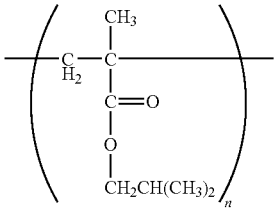

Production of Copolymer 4

A copolymer 4 was obtained in the same manner as in the production of the copolymer 1 except for using 10 parts by mass of a macromonomer (m:n=50:50, average value of m+n=50) having a styrene-acrylonitrile copolymer portion having a weight average molecular weight of 7000 which has a structure represented by the following formula (8) instead of the macromonomer represented by the formula (4) and using 46 parts by mass of a stearyl methacrylate monomer having a structure represented by the following formula (9) instead of the monomer represented by the formula (5) and further using 44 parts by mass of a methyl methacrylate monomer. The copolymer 4 had a solid content of 33% by mass, a weight average molecular weight of 49000 and a Tg of 82° C. The physical properties of the resulting copolymer 4 are shown in Table 1.

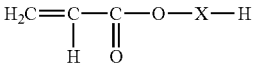

(8)

(In the formula, X represents a copolymer structure comprised of the following chemical formulas.)

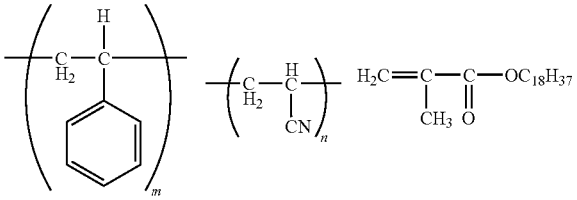

(9)

Production of Copolymer 5

A copolymer 5 was obtained in the same manner as in the production of the copolymer 1 except for using 5 parts by mass of a 2-ethylhexyl methacrylate monomer (average vale n=28) having a weight average molecular weight of 5600 and having a structure represented by the following formula (10) instead of the macromonomer represented by the formula (4) and using 60 parts by mass of a isobutyl methacrylate monomer having a structure represented by the following formula (II) instead of the monomer represented by the formula (5) and further using 35 parts by mass of a methyl methacrylate monomer. The resulting copolymer 5 had solid content of 33% by mass, a weight average molecular weight of 57000 and a Tg of 89° C. The physical properties of the resulting copolymer 5 are shown in Table 1.

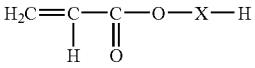

(10)

(In the formula, X is represented by the following chemical formula.)

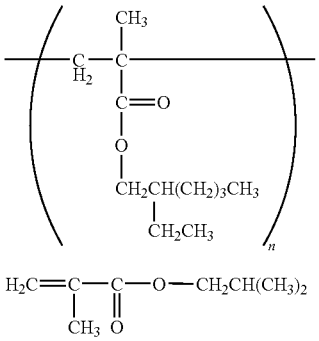

(11)

Production of Copolymer 6

A copolymer 6 was obtained in the same manner as in the production of the copolymer 1 except for using 30 parts by weight of a macromonomer represented by the formula (4), using 60 parts by mass of the monomer represented by the formula (5) and further using 10 parts by mass of a methyl methacrylate monomer. The resulting copolymer 6 had solid content of 33% by mass, a weight average molecular weight of 55000 and a Tg of 95° C. The physical properties of the resulting copolymer 6 are shown in Table 1.

Production of Copolymer 7

An aqueous solution was prepared by adding 450 parts by mass of a 0.12 mol/l-$Na_3PO_4$ aqueous solution to 700 parts by mass of ion-exchanged water. The aqueous solution was heated at 60° C. and stirred at 15000 rpm with a TK-type homomixer (manufactured by PRIMIX Corporation). To the resulting aqueous solution was gradually added 70 parts by mass of a 1.2 mol/l-$CaCl_2$ aqueous solution to obtain an aqueous medium containing $Ca_3(PO_4)_2$. In a material comprised of 75 parts by mass of the monomer represented by the formula (5), 23 parts by mass of a methyl methacrylate monomer and 2 parts by mass of the macromonomer represented by the formula (4) was dissolved 4 parts by mass of a polymerization initiator, 2,2'-azobis(2,4-dimethylvaleronitrile), and the resulting mixture was added into the aqueous medium. The resulting aqueous medium was granulated by maintaining at 60° C. and stirring under a nitrogen atmosphere at 12000 rpm for 10 minutes with a TK-type homomixer. Thereafter, the granulated product was heated at 80° C. while stirring with a paddle stirring blade to allow to react for 10 hours. After the polymerization reaction, residual monomers were removed under reduced pressure. After cooling, hydrochloric acid was added to dissolve $Ca_3(PO_4)_2$. The resulting particles were filtered off, followed by washing with water and drying to obtain a particulate copolymer 7. The resulting copolymer 7 had an average particle diameter (D50) of 7.7 μm, a weight average molecular weight of 135000 and a Tg of 90° C. The physical properties of the resulting copolymer 7 are shown in Table 1.

Production of Copolymer 8

A copolymer 8 was obtained in the same manner as in the production of the copolymer 1 except for using a propyl methacrylate monomer instead of the monomer represented by the formula (5). The resulting copolymer 8 had solid content of 33% by mass, a weight average molecular weight of 53000 and a Tg of 100° C. The physical properties of the resulting copolymer 8 are shown in Table 1.

Production of Copolymer 9

A copolymer 9 was obtained in the same manner as in the production of the copolymer 1 except for using only 100 parts by mass of a methyl methacrylate monomer as the monomers used. The resulting copolymer 9 had solid content of 33% by mass, a weight average molecular weight of 61000 and a Tg of 103° C. The physical properties of the resulting copolymer 9 are shown in Table 1.

TABLE 1

| Copolymer | Composition (ratio by mass) | Weight Average Molecular Weight Mw | Glass Transition Temperature Tg (° C.) |
|---|---|---|---|
| 1 | Equation (4):Equation (5) = 25:75 | 56000 | 91 |
| 2 | Equation (6):Equation (5) = 25:75 | 58000 | 95 |
| 3 | Equation (7):Equation (5):MMA = 10:65:25 | 52000 | 91 |
| 4 | Equation (8):Equation (9):MMA = 10:46:44 | 49000 | 82 |
| 5 | Equation (10):Equation (11):MMA = 5:60:35 | 57000 | 89 |
| 6 | Equation (4):Equation (5):MMA = 30:60:10 | 55000 | 95 |
| 7 | Equation (4):Equation (5):MMA = 2:75:23 | 135000 | 90 |
| 8 | Equation (4):Propyl Methacrylate = 25:75 | 53000 | 100 |
| 9 | MMA = 100 | 61000 | 103 |

Production of Carrier Core (a)

Into a container were introduced magnetite fine particles (spherical form, number average particle diameter: 250 nm, magnetization intensity: 65 $Am^2/kg$, residual magnetization: 4.2 $Am^2/kg$, coercive force: 4.4 kA/m, specific resistance at 500 V/cm: $3.3\times10^5$ Ω·cm) and a silane coupling agent (3-(2-aminoethylaminopropyl)trimethoxysilane) (in an amount of 3.0% by mass based on the mass of the magnetite fine particles). Thereafter, the mixture was subjected to surface treatment by mixing and stirring at 100° C. or higher at a high speed in the container. Into a reaction kettle was introduced a material comprised of 10 parts by mass of phenol, 16 parts by mass of a formaldehyde solution (an aqueous solution of 37% by mass of formaldehyde) and 84 parts by mass of the surface treated magnetite fine particles, followed by mixing well at 40° C.

Thereafter, the resulting mixture was heated to 85° C. at an average temperature-rising rate of 3° C./rain under stirring, followed by adding 4 parts by mass of 28% by mass of aqueous ammonia and 25 parts by mass of water into the reaction kettle. The temperature of the resulting mixture was maintained at 85° C. and was cured by subjecting to polymerization reaction for 3 hours. The peripheral velocity of the stirring blade at that time was set at 1.8 m/s.

After the polymerization reaction, the resulting product was cooled to 30° C., followed by addition of water. A precipitate obtained by removing the supernatant was washed and further air dried. The air-dried product obtained was dried at a temperature of 60° C. under reduced pressure (5 hPa or lower) to obtain a carrier core (a) having a 50% particle diameter (D50) on a volume distribution basis of 35 μm and a loose apparent density of 1.90 g/cm$^3$ in which a magnetic material was dispersed in the resin. The carrier core (a) had a specific resistance of $2.2\times10^8$ Ω·cm, a packed apparent density of 2.11 g/cm$^3$ and a true density of 3.60 g/cm$^3$. In addition, the carrier core (a) had a magnetization intensity of 55 Am$^2$/kg, a residual magnetization of 3.5 Am$^2$/kg and a coercive force of 4.3 kA/m. The physical properties of the resulting carrier core (a) are shown in Table 2.

Production of Carrier Core (b)

A carrier core (b) was produced in the same manner as in the production of the carrier core (a) except for changing the peripheral velocity of the stirring blade at the time of mixing of materials to 2.2 m/s. The resulting carrier core (b) had a 50% particle diameter (D50) on a volume distribution basis of 16 μm and a loose apparent density of 1.72 g/cm$^3$. The carrier core (b) had a specific resistance of $2.6\times10^8$ Ω·cm, a packed apparent density of 2.02 g/cm$^3$ and a true density of 3.58 g/cm$^3$. In addition, the carrier core (b) had a magnetization intensity of 54 Am$^2$/kg, a residual magnetization of 3.6 Am$^2$/kg and a coercive force of 4.4 kA/m. The physical properties of the resulting carrier core (b) are shown in Table 2.

Production of Carrier Core (c)

The particles of $Fe_2O_3$, CuO and ZnO were weighed such that the molar ratio of $Fe_2O_3$, CuO and ZnO was 50 mol %, 26 mol % and 24 mol %, respectively, followed by mixing for 10 hours in a ball mill. After the ferrite composition was mixed in a wet system, the mixture composition was calcined at 900° C. for two hours, and the calcined ferrite composition was pulverized with the ball mill. The resulting pulverized product had a number average particle diameter of 0.4

To the resulting pulverized product were added water (300% by mass based on the pulverized product) and a polyvinyl alcohol having a weight average molecular weight of 5000 (1.5% by mass based on the pulverized product), and the resulting mixture was granulated with a spray dryer. The granulated product was sintered at 1050° C. for 15 hours under an atmosphere of an oxygen concentration of 8.9% while supplying oxygen in an electric furnace. The sintered product was ground and classified to obtain a carrier core (c) having a 50% particle diameter (D50) on a volume distribution basis of 99 μm and a loose apparent density of 2.45 g/cm$^3$. The carrier core (c) had a specific resistance of $6.4\times10^8$ Ω·cm, a packed apparent density of 2.83 g/cm$^3$ and a true density of 5.03 g/cm$^3$. In addition, the carrier core (c) had a magnetization intensity of 60 Am$^2$/kg, a residual magnetization of 0.4 Am$^2$/kg and a coercive force of 0.3 kA/m. The physical properties of the resulting carrier core (c) are shown in Table 2.

Production of Carrier Core (d)

The particles of $Fe_2O_3$, $MnCO_3$, $Mg(OH)_2$ and $SrCO_3$ were weighed such that the molar ratio of $Fe_2O_3$, $MnCO_3$, $Mg(OH)_2$ and $SrCO_3$ was 66 mol %, 28 mol %, 5 mol % and 1 mol %, respectively, followed by mixing for 10 hours in a ball mill. After the ferrite composition was mixed in a wet system, the mixture composition was calcined at 900° C. for two hours, and the calcined ferrite composition was pulverized with the ball mill. The resulting pulverized product had a number average particle diameter of 0.4 μm.

To the resulting pulverized product were added water (300% by mass based on the pulverized product), a polyvinyl alcohol having a weight average molecular weight of 5000 (2.5% by mass based on the pulverized product) and $Na_2CO_3$ (having a weight average particle size of 2 μm) (5% by mass based on the pulverized product) as a hole forming agent, and the resulting mixture was granulated with a spray dryer. The granulated product was sintered at 1200° C. for 12 hours under a nitrogen atmosphere of an oxygen concentration of 1.0% in an electric furnace. The sintered product was ground and classified to obtain a carrier core (d) having a 50% particle diameter (D50) on a volume distribution basis of 38 μm and a loose apparent density of 1.62 g/cm$^3$. The carrier core (d) had a specific resistance of $1.3\times10^7$ Ω·cm, a packed apparent density of 1.74 g/cm$^3$ and a true density of 4.81 g/cm$^3$. In addition, the carrier core (d) had a magnetization intensity of 71 Am$^2$/kg, a residual magnetization of 1.8 Am$^2$/kg and a coercive force of 1.2 kA/m. The physical properties of the resulting carrier core (d) are shown in Table 2.

Production of Carrier Core (e)

The particles of $Fe_2O_3$, $MnCO_3$, $Mg(OH)_2$ and $SrCO_3$ were weighted such that the molar ratio of $Fe_2O_3$, $MnCO_3$, $Mg(OH)_2$ and $SrCO_3$ was 66 mol %, 28 mol %, 5 mol % and 1 mol %, respectively, followed mixing for 10 hours in a ball mill. After the ferrite composition was mixed in a wet system, the mixture composition was calcined at 900° C. for two hours, and the calcined ferrite composition was pulverized with the ball mill. The resulting pulverized product had a number average particle diameter of 0.5 μm.

To the resulting pulverized product were added water (300% by mass based on the pulverized product), a polyvinyl alcohol having a weight average molecular weight of 5000 (1.5% by mass based on the pulverized product) and $Na_2CO_3$ (having a weight average particle size of 2 μm) (2% by mass based on the pulverized product) as a hole forming agent, and the resulting mixture was granulated with a spray dryer. At that time, the granulation was performed by decreasing the disk rotating speed as compared to the case of the carrier core (d). The resulting particles were sintered at 1230° C. for 12 hours under a nitrogen atmosphere of an oxygen concentration of 1.0% in an electric furnace. The sintered particles were ground and classified to obtain a carrier core (e) having a 50% particle diameter (D50) on a volume distribution basis of 48 and a loose apparent density of 1.79 g/cm$^3$. The carrier core (e) had a specific resistance of $1.1\times10^7$ Ω·cm, a packed apparent density of 1.99 g/cm$^3$ and a true density of 4.82 g/cm$^3$. In addition, the carrier core (e) had a magnetization intensity of 72 Am$^2$/kg, a residual magnetization of 1.9 Am$^2$/kg and a coercive force of 1.3 kA/m. The physical properties of the resulting carrier core (e) are shown in Table 2.

TABLE 2

| Carrier Core | D50 (μm) | Loose Apparent Density ($g/cm^3$) | Packed Apparent Density ($g/cm^3$) | True Density ($g/cm^3$) | Specific Resistance ($\Omega \cdot cm$) | Magnetization Intensity ($Am^2/kg$) | Residual Magnetization ($Am^2/kg$) | Coercive Force (kA/m) |
|---|---|---|---|---|---|---|---|---|
| a | 35 | 1.90 | 2.11 | 3.60 | $2.2 \times 10^8$ | 55 | 3.5 | 4.3 |
| b | 16 | 1.72 | 2.02 | 3.58 | $2.6 \times 10^8$ | 54 | 3.6 | 4.4 |
| c | 99 | 2.45 | 2.83 | 5.03 | $6.4 \times 10^8$ | 60 | 0.4 | 0.3 |
| d | 38 | 1.62 | 1.74 | 4.81 | $1.3 \times 10^7$ | 71 | 1.8 | 1.2 |
| e | 48 | 1.79 | 1.99 | 4.82 | $1.1 \times 10^7$ | 72 | 1.9 | 1.3 |

Production Example of Magnetic Carrier A

The copolymer (1) was dissolved in toluene such that the solid content of the polymer (1) was 10% by mass. To the toluene solution was added separately three times a coating solution such that the coated amount (as a solid content) was 1.0 parts by mass based on 100 parts by mass of the carrier core (a) by using a versatile mixing and stirring machine (manufactured by Fuji Paudal Co., Ltd.) as a coating apparatus. At that time, the mixing machine was depressurized and the atmosphere in the mixing machine was replaced with nitrogen by introducing nitrogen gas thereto. The resulting mixture was heated at 65° C. and stirred while maintaining the reduced pressure (700 MPa) under a nitrogen atmosphere, and the solvents were completely removed until the carrier becomes loose. While further continuing the stirring and introducing nitrogen, the carrier was heated at 100° C. and maintained for one hour. After cooling, a magnetic carrier A was obtained. The physical properties of the resulting magnetic carrier A are shown in Table 3.

Production Example of Magnetic Carrier B

A magnetic carrier B was obtained in the same manner as in the production example of the magnetic carrier A except for using a toluene solution of the copolymer (3). The physical properties of the resulting magnetic carrier B are shown in Table 3.

Production Example of Magnetic Carrier C

A magnetic carrier C was obtained in the same manner as in the production example of the magnetic carrier A except for using a toluene solution of the copolymer (4). The physical properties of the resulting magnetic carrier C are shown in Table 3.

Production Example of Magnetic Carrier D

A resin solution was obtained by mixing a material comprised of 20.0% by mass of a straight silicone (KR255, produced by Shin-Etsu Chemical Co., Ltd), 0.5% by mass of γ-aminopropyltriethoxysilane and 79.5% by mass of toluene. Resin filling was performed by using the resulting resin solution such that the resin solution was contained in an amount of 13.5 parts by mass based on 100 parts by mass of the carrier core (d). The filling of the resin is performed by heating the resin solution at 70° C. under a vacuum degree of 50 kPa by using a versatile mixing and stirring machine (manufactured by Fuji Paudal Co., Ltd.). The resin solution was added separately three times, followed by stirring for one hour. Thereafter, toluene was removed by heating the resin solution at 100° C. for two hours under a vacuum degree of 5 kPa. Further, the resulting resin was cured by heating at 200° C. for two hours by using an oven while flowing nitrogen, thereby obtaining particles filled with resin (d').

A magnetic carrier D was obtained in the same manner as in the production example of the magnetic carrier A except for using the particles filled with resin (d') instead of the carrier core (a). The preparation conditions and physical properties of the resulting magnetic carrier D are shown in Table 3.

Production Example of Magnetic Carrier E

A magnetic carrier E was obtained in the same manner as in the production example of the magnetic carrier D except for using a toluene solution of the copolymer (6). The physical properties of the resulting magnetic carrier E are shown in Table 3.

Production Example of Magnetic Carrier F

A magnetic carrier F was obtained by premixing a material comprised of 100 parts by mass of the particles filled with resin (d') and 1.5 parts by mass of the copolymer (7) with a Henschel mixer and then performing resin coating using an apparatus shown in FIG. 3. The coating conditions were a filling rate of 95% by volume, an outermost peripheral speed of 10 m/s, an interval between a stirring blade and a casing of 3.0 mm and a processing time of 20 minutes. Further, cooling water at 15 liters/min was introduced in the jacket and the temperature (product temperature) of the processed material at the time of coating was 76° C. The physical properties of the resulting magnetic carrier F are shown in Table 3.

Production Example of Magnetic Carrier G

The copolymer (2) was dissolved in toluene such that the solid content of the polymer (2) was 10% by mass. The resin coating was performed by using Spiraflow (manufactured by Freund Corporation) as a coating apparatus such that the coated amount (as a solid content) was 2.0 parts by mass based on 100 parts by mass of the particles filled with resin (d'), thereby obtaining a magnetic carrier G. The coating conditions were a hot air inlet temperature of 70° C., an air flow rate of 0.8 $m^3$/min, a disk rotating speed of 1000 $min^{-1}$ and a spraying pressure of the resin solution of 4 $kg/cm^2$. In addition, after the completion of coating, the coated resin solution was dried at 80° C. for one hour in order to remove the solvents. The physical properties of the resulting magnetic carrier G are shown in Table 3.

Production Example of Magnetic Carrier H

A magnetic carrier H was obtained in the same manner as in the production example of the magnetic carrier A except for using the carrier core (e) instead of the carrier core (a) and changing the coated amount to 1.5 parts by mass based on 100 parts by mass of the carrier core (e). The physical properties of the resulting magnetic carrier H are shown in Table 3.

Production Example of Magnetic Carrier I

A magnetic carrier I was obtained by premixing a material comprised of 100 parts by mass of the carrier core (e) and 1.5 parts by mass of the copolymer (7) with a Henschel mixer and then performing resin coating using an apparatus shown in FIG. 3. The coating conditions were a filling rate of 95% by volume, an outermost peripheral speed of 10 m/s, an interval between a stirring blade and a casing of 3.0 mm and a processing time of 20 minutes. Further, cooling water at 15 liters/min was introduced in the jacket and the temperature (product temperature) of the processed material at the time of coating was 78° C. The physical properties of the resulting magnetic carrier I are shown in Table 3.

Production Example of Magnetic Carrier J

A magnetic carrier J was obtained in the same manner as in the production example of the magnetic carrier A except for using a toluene solution of the copolymer (8), using the carrier core (e) instead of the carrier core (a) and changing the coated amount to 1.5 parts by mass based on 100 parts by mass of the carrier core (e). The physical properties of the resulting magnetic carrier J are shown in Table 3.

Production Example of Magnetic Carrier K

A magnetic carrier K was obtained in the same manner as in the production example of the magnetic carrier A except for using a toluene solution of the copolymer (9), using the carrier core (e) instead of the carrier core (a) and changing the coated amount to 1.5 parts by mass based on 100 parts by mass of the carrier core (e). The physical properties of the resulting magnetic carrier K are shown in Table 3.

Production Example of Magnetic Carrier L

A magnetic carrier L was obtained in the same manner as in the production example of the magnetic carrier A except for using a toluene solution of the copolymer (4), using the carrier core (b) instead of the carrier core (a) and changing the coated amount to 2.0 parts by mass based on 100 parts by mass of the carrier core (b). The physical properties of the resulting magnetic carrier L are shown in Table 3.

Production Example of Magnetic Carrier M

A magnetic carrier M was obtained in the same manner as in the production example of the magnetic carrier A except for using a toluene solution of the copolymer (5), using the carrier core (b) instead of the carrier core (a) and changing the coated amount to 2.0 parts by mass based on 100 parts by mass of the carrier core (b). The physical properties of the resulting magnetic carrier M are shown in Table 3.

Production Example of Magnetic Carrier N

A magnetic carrier N was obtained in the same manner as in the production example of the magnetic carrier A except for using a toluene solution of the copolymer (5), using the carrier core (c) instead of the carrier core (a) and changing the coated amount to 0.8 parts by mass based on 100 parts by mass of the carrier core (c). The physical properties of the resulting magnetic carrier N are shown in Table 3.

Production Example of Magnetic Carrier O

A magnetic carrier O was obtained in the same manner as in the production example of the magnetic carrier G except for changing the particles filled with resin (d') to the carrier core (b). The physical properties of the resulting magnetic carrier O are shown in Table 3.

Production Example of Magnetic Carrier P

A magnetic carrier P was obtained in the same manner as in the production example of the magnetic carrier A except for using a toluene solution of the copolymer (8), using the carrier core (c) instead of the carrier core (a) and changing the coated amount to 0.8 parts by mass based on 100 parts by mass of the carrier core (c). The physical properties of the resulting magnetic carrier P are shown in Table 3.

Production Example of Magnetic Carrier Q

A magnetic carrier Q was obtained in the same manner as in the production example of the magnetic carrier A except for using a toluene solution of the copolymer (9), using the carrier core (c) instead of the carrier core (a) and changing the coated amount to 0.8 parts by mass based on 100 parts by mass of the carrier core (c). The physical properties of the resulting magnetic carrier Q are shown in Table 3.

Production Example of Magnetic Carrier R

Into a mayonnaise bottle was added a material comprised of 100 parts by mass of the copolymer (3) (solid content: 33% by mass), 3.3 parts by mass of crosslinked melamine particles (having a peak diameter of 250 nm based on the number distribution) and 1.6 parts by mass of carbon black (Printex 90, produced Degussa Corporation) together with 80 parts by mass of glass beads having a diameter of 1 mm and the resulting material was dispersed for two hours with a paint shaker. Thereafter, the glass beads were filtered off with a nylon mesh and the toluene was added such that the solid content was 10% by mass. A magnetic carrier R was obtained in the same manner as in the production example of the magnetic carrier A except for using the toluene solution and changing the coated amount to 1.15 parts by mass based on 100 parts by mass of the carrier (a). The physical properties of the resulting magnetic carrier R are shown in Table 3.

TABLE 3

| | | Coating Formula | | | | Carrier Physical Properties | | | |
|---|---|---|---|---|---|---|---|---|---|
| | Carrier Core | Copolymer | Coated Amount (parts by mass) | Particle Added | Conductive Material | 50% Particle Diameter (μm) | True Density (g/cm$^3$) | Specific Resistance (Ω · cm) | Deviation of Specific Resistance |
| Carrier A | a | 1 | 1.0 | — | — | 36 | 3.57 | $5.2 \times 10^9$ | 0.11 |
| Carrier B | a | 3 | 1.0 | — | — | 36 | 3.56 | $3.9 \times 10^9$ | 0.16 |
| Carrier C | a | 4 | 1.0 | — | — | 36 | 3.55 | $6.2 \times 10^8$ | 0.20 |
| Carrier D | d' | 1 | 1.0 | — | — | 40 | 3.62 | $2.2 \times 10^8$ | 0.10 |
| Carrier E | d' | 6 | 1.0 | — | — | 40 | 3.60 | $1.7 \times 10^8$ | 0.13 |

TABLE 3-continued

| | | Coating Formula | | | | Carrier Physical Properties | | | |
|---|---|---|---|---|---|---|---|---|---|
| | Carrier Core | Copolymer | Coated Amount (parts by mass) | Particle Added | Conductive Material | 50% Particle Diameter (μm) | True Density (g/cm$^3$) | Specific Resistance (Ω · cm) | Deviation of Specific Resistance |
| Carrier F | d' | 7 | 1.5 | — | — | 39 | 3.58 | $2.1 \times 10^{10}$ | 0.14 |
| Carrier G | d' | 2 | 2.0 | — | — | 40 | 3.56 | $9.8 \times 10^{12}$ | 0.16 |
| Carrier H | e | 1 | 1.5 | — | — | 50 | 4.81 | $9.9 \times 10^{7}$ | 0.13 |
| Carrier I | e | 7 | 1.5 | — | — | 48 | 4.77 | $2.1 \times 10^{9}$ | 0.14 |
| Carrier J | e | 8 | 1.5 | — | — | 50 | 4.69 | $8.9 \times 10^{7}$ | 0.26 |
| Carrier K | e | 9 | 1.5 | — | — | 51 | 4.70 | $2.3 \times 10^{9}$ | 0.27 |
| Carrier L | b | 4 | 2.0 | — | — | 19 | 3.50 | $1.1 \times 10^{10}$ | 0.17 |
| Carrier M | b | 5 | 2.0 | — | — | 20 | 3.51 | $4.2 \times 10^{10}$ | 0.17 |
| Carrier N | c | 5 | 0.8 | — | — | 99 | 5.00 | $3.5 \times 10^{9}$ | 0.19 |
| Carrier O | b | 2 | 2.0 | — | — | 20 | 3.52 | $1.5 \times 10^{12}$ | 0.14 |
| Carrier P | c | 8 | 0.8 | — | — | 100 | 5.01 | $1.5 \times 10^{8}$ | 0.38 |
| Carrier Q | c | 9 | 0.8 | — | — | 101 | 5.00 | $5.6 \times 10^{8}$ | 0.42 |
| Carrier R | a | 3 | 1.0 | Melamine particles | Carbon Black | 37 | 3.58 | $7.8 \times 10^{7}$ | 0.15 |

*The particles filled with resin d' is one in which a hole of the carrier core d is filled with a resin.

Production Example 1 of Toner

As a material for obtaining a vinyl copolymer unit, a dropping funnel was loaded with 10 parts by mass of styrene, 5 parts by mass of 2-ethylhexyl acrylate, 2 parts by mass of fumaric acid, 5 parts by mass of a dimer of α-methylstyrene and 5 parts by mass of dicumyl peroxide. In addition, as a material for obtaining a polyester polymer unit, a 4-liter glass four-necked flask was charged with 25 parts by mass of polyoxypropylene(2.2)-2,2-bis(4-hydroxyphenyl)propane, 15 parts by mass of polyoxyethylene(2.2)-2,2-bis(4-hydroxyphenyl)propane, 9 parts by mass of terephthalic acid, 5 parts by mass of anhydrous trimellitic acid, 24 parts by mass of fumaric acid and 0.2 parts by mass of tin 2-ethylhexanate. The four-necked flask was equipped with a thermometer, a stirring rod, a condenser and a nitrogen introducing tube and was disposed in a mantle heater. Subsequently, after air in the four-necked flask was replaced with a nitrogen gas, the flask was gradually heated under stirring, and while stirring the mixture in the flask at a temperature of 130° C., the vinyl monomer and a polymerization initiator were dropwise added from the dropping funnel over approximately 4 hours. Thereafter, the temperature of the resulting mixture was increased to 200° C., followed by allowing to react for 4 hours to obtain a hybrid resin having a weight average molecular weight of 78000 and a number average molecular weight of 3800.

After mixing a material of the formula comprising 100 parts by mass of the hybrid resin, 5 parts by mass of a purified normal paraffin (maximum endothermic peak temperature: 80° C.), 0.5 parts by mass of the aluminum compound of 3,5-di-t-butylsalycilic acid and 6 parts by mass of C.I. Pigment Blue 15:3 with a Henschel mixer (FM-75 Type, manufactured by Mitsui Mining Co., Ltd.), the resulting mixture was kneaded with a twin-screw kneader (Model PCM-30, manufactured by Ikegai Corporation) set at 130° C. The resulting kneaded product was allowed to cool and then was roughly pulverized with a hammer mill into a powder having a particle diameter of 1 mm or less to obtain a roughly pulverized product. The resulting roughly pulverized toner product was finely pulverized with a collision airflow pulverizer using a highly pressurized gas. Further, the resulting finely pulverized product was classified, followed by being subjected to spheronization treatment five times using a hybridizer (manufactured by Nara Machinery Co., Ltd.) to obtain cyan toner particles having a weight average particle diameter (D4) of 5.8 μm and an average circularity of 0.957.

To 100 parts by mass of the resulting cyan toner particles, 1.0 parts by mass of silica particles having a peak particle diameter of 110 nm based on the number distribution and a hydrophobicity degree of 94 which was treated with hexamethyldisilazane, 0.9 parts by mass of titanium oxide particles having a peak particle diameter of 50 nm based on the number distribution and a hydrophobicity degree of 70 and 0.5 parts by mass of silicone oil-treated silica particles having a peak particle diameter of 20 nm based on the number distribution and a hydrophobicity degree of 98 were added. Thereafter, the resulting mixture was mixed with a Henschel mixer (manufactured by Mitsui Mining Co., Ltd.) to obtain a cyan toner 1 having a weight average particle diameter of 5.9 μm and an average circularity of 0.956.

Production Example 2 of Toner

An aqueous solution was prepared by adding 600 parts by mass of a 0.12 mol/l-$Na_3PO_4$ aqueous solution to 500 parts by mass of ion-exchanged water. The aqueous solution was heated at 60° C. and stirred at 11000 rpm with a TK-type homomixer (manufactured by PRIMIX Corporation). To the resulting aqueous solution was gradually added 93 parts by mass of a 1.2 mol/l-$CaCl_2$ aqueous solution to obtain an aqueous medium containing $Ca_3(PO_4)_2$. The following materials were heated at 60° C. and uniformly mixed and dispersed at 10000 rpm with a TK-type homomixer (manufactured by PRIMIX Corporation). The materials were comprised of 162 parts by mass of styrene, 38 parts by mass of n-butylacrylate, 20 parts by mass of an ester wax (maximum endothermic peak temperature: 72° C.), 1 parts by mass of an aluminum compound of 3,5-di-t-butylsalycilic acid, 10 parts by mass of a saturated polyester (terephthalic acid-propylene oxide-modified bisphenol A, acid value: 15 mgKOH/g, peak molecular weight: 6000) and 12 parts by mass of C.I. Pigment Blue 15:3. In the dispersed product was dissolved 8 parts by mass of a polymerization initiator, 2,2'-azobis(2,4-dimethylvaleronitrile) to prepare a polymerizable monomer composition.

The polymerizable monomer composition was added into the aqueous medium at 60° C. under a nitrogen atmosphere, followed by stirring for 10 minutes at 15000 rpm with a TK-type homomixer to granulate. Thereafter, the granulated product was heated at 80° C. while stirring with a paddle stirring blade to allow to react for 10 hours. After the polymerization reaction, residual monomers were distilled off under reduced pressure. After cooling, hydrochloric acid was added to dissolve $Ca_3(PO_4)_2$. The resulting particles were filtered, followed by washing with water and drying to obtain cyan toner particles having a weight average particle diameter (D4) of 3.4 μm and an average circularity of 0.980.

To 100 parts by mass of the resulting cyan toner particles were added 0.5 parts by mass of silica particles having a peak particle diameter of 80 nm based on the number distribution and a hydrophobicity degree of 93 which was treated with hexamethyldisilazane, 0.8 parts by mass of titanium oxide particles having a peak particle diameter of 40 nm based on the number distribution and a hydrophobicity degree of 65 and 1.2 parts by mass of silica particles having a peak particle diameter of 30 nm based on the number distribution and a hydrophobicity degree of 95. Thereafter, the resulting mixture was mixed with a Henschel mixer (manufactured by Mitsui Mining Co., Ltd.) to obtain a cyan toner 2 having a weight average particle diameter (D4) of 3.4 μm and an average circularity of 0.979.

Production Example 3 of Toner

To 100 parts by mass of the cyan toner particles obtained in the production example 1 of a toner, 1.0 parts by mass of silica particles having a peak particle diameter of 200 nm based on the number distribution and a hydrophobicity degree of 95 which was treated with hexamethyldisilazane, 0.9 parts by mass of titanium oxide particles having a peak particle diameter of 50 nm based on the number distribution and a hydrophobicity degree of 70 and 0.5 parts by mass of silicone oil-treated silica particles having a peak particle diameter of 20 nm based on the number distribution and a hydrophobicity degree of 98 were added. Thereafter, the resulting mixture was mixed with a Henschel mixer (manufactured by Mitsui Mining Co., Ltd.) to obtain a cyan toner 3 having a weight average particle diameter (D4) of 5.8 μm and an average circularity of 0.955.

Production Example 4 of Toner

There were obtained cyan toner particles having a weight average particle diameter (D4) of 5.8 μm and an average circularity of 0.942 in the same manner as in the production example 1 of a toner except for performing the hybridizer treatment once. To 100 parts by mass of the resulting cyan toner particles, 1.0 parts by mass of silica particles having a peak particle diameter of 110 nm based on the number distribution and a hydrophobicity degree of 94 which was treated with hexamethyldisilazane, 0.9 parts by mass of titanium oxide particles having a peak particle diameter of 50 nm based on the number distribution and a hydrophobicity degree of 70 and 0.5 parts by mass of silicone oil-treated silica particles having a peak particle diameter of 20 nm based on the number distribution and a hydrophobicity degree of 98 were added. Thereafter, the resulting mixture was mixed with a Henschel mixer (manufactured by Mitsui Mining Co., Ltd.) to obtain a cyan toner 4 having a weight average particle diameter (D4) of 5.8 μm and an average circularity of 0.941.

Production Example 5 of Toner

To 100 parts by mass of the cyan toner particles obtained in the production example 4 of a toner, 0.9 parts by mass of titanium oxide particles having a peak particle diameter of 50 nm based on the number distribution and a hydrophobicity degree of 70 and 0.5 parts by mass of silicone oil-treated silica particles having a peak particle diameter of 20 nm based on the number distribution and a hydrophobicity degree of 98 were added. Thereafter, the resulting mixture was mixed with a Henschel mixer (manufactured by Mitsui Mining Co., Ltd.) to obtain a cyan toner 5 having a weight average particle diameter (D4) of 5.8 μm and an average circularity of 0.942.

TABLE 4

| Toner | Weight Average Particle Diameter D4 (μm) | Average Circularity | Particle Diameter of Externally Added Silica Particles having a Maximum Peak Particle Diameter of 80 to 200 nm (nm) |
|---|---|---|---|
| 1 | 5.9 | 0.956 | 110 |
| 2 | 3.4 | 0.979 | 80 |
| 3 | 5.8 | 0.955 | 200 |
| 4 | 5.8 | 0.941 | 110 |
| 5 | 5.8 | 0.942 | — |

Example 1

A two-components developer was prepared by adding 8 parts by mass of the toner 1 to 92 parts by mass of the carrier A and followed by mixing for 2 minutes with a Turbler mixer. Tables 5 and 6 show the results obtained by performing the following evaluations using the two-components developer.

By using a modified apparatus of a full-color copying machine iRC5180 manufactured by Canon Inc. as an image forming apparatus, the developer was charged into a developing unit at the cyan position and image formation was performed under the environment of normal temperature and low humidity (23° C., 10% RH) or high humidity and high temperature (30° C., 80% RH). As the developing conditions, the copying machine was modified such that the interval (between S-D) between the developing sleeve and the developing electrode of the photosensitive member was 300 μm and the peripheral velocity of the developing sleeve to the photosensitive member was 1.5 times by changing the laser spot diameter so as to obtain an image having a resolution of 600 dpi and rotating a developing sleeve and a photosensitive member in a forward direction in a developing region. Thereafter, an AC voltage (frequency: 2.0 kHz, Vpp: 1.5 kV) and a DC voltage, $V_{DC}$ were applied to the developing sleeve. Under these conditions, a 30000-sheet image output test was performed by using an image having an image area of 5% and the following evaluations were performed.

(1) Contrast Required (Before Duration and After Duration)

A developing contrast (an absolute value between the direct current voltage ($V_{DC}$) and the bright portion potential ($V_L$)) was determined, which is required so that the toner amount developed on the photosensitive member was 0.55 mg/cm$^2$.

Figure 5:
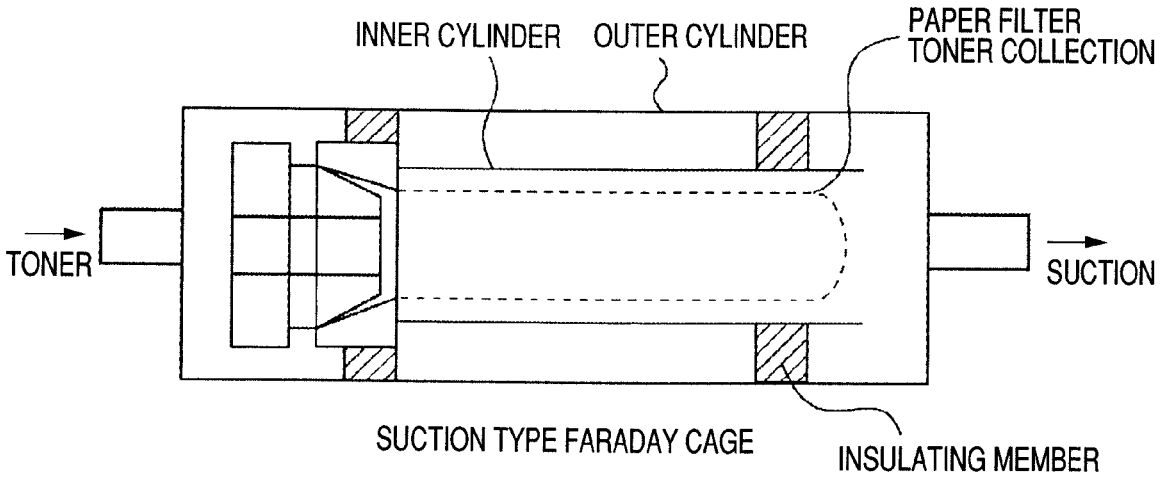
FIG. 5 is a pattern diagram illustrating a structure of a configuration of a Faraday cage.

The specific measurement method is described below. Firstly, a solid image was developed by setting the developing contrast at 180 V. Thereafter, the photosensitive member was taken out from the copying machine before transferring, and the toner on the photosensitive member was suctioned and collected using a Faraday cage having a structure shown in FIG. 5. The charging amount Q of the toner collected was measured with an electrometer (a Keithley electrometer 6517, manufactured by Keithley Instruments Inc.), and separately, the mass M of the toner collected was measured. Thereafter, the toner amount was measured using the area suctioned and the mass M of the toner measured. If the toner amount is less than 0.55 mg/cm$^2$, the measurement was continued by resetting the development contrast to increase every 10 V until the toner amount is 0.55 mg/cm$^2$.

A: The developing contrast is from 300 to less than 380 V.

B: The developing contrast is from 260 to less than 300 V or from 380 to less than 420V.

C: The developing contrast is from 220 to less than 260 V or from 420 to less than 450 V.

D: The developing contrast is from 180 to less than 220 V or from 450 to less than 470 V.

E: The developing contrast is from less than 180 V or more than 470 V.

(2) Charging Amount

The charging amount Q/M (mC/kg) per unit mass was calculated using the charging amount Q at the time of the toner amount of 0.55 mg/cm$^2$ and the mass M of the toner, which were measured in the evaluation of the contrast required.

(3) Charging Amount Change

Under a developing condition where the toner amount was 0.55 mg/cm$^2$, a 30000-sheet image output test was performed and the difference in the charging amount before and after the test was measured. The charging amount before duration was defined as the charging amount at the time of the second sheet image output.

The evaluation criteria are as follows:

A: The absolute value of the difference in the charging amount is 1.0 mC/kg or less.

B: The absolute value of the difference in the charging amount is more than 1.0 mC/kg and 3.0 mC/kg or less.

C: The absolute value of the difference in the charging amount is more than 3.0 mC/kg and 5.0 mC/kg or less.

D: The absolute value of the difference in the charging amount is more than 5.0 mC/kg and 7.0 mC/kg or less.

E: The absolute value of the difference in the charging amount is more than 7.0 mC/kg.

(4) Dot Reproducibility (Second Sheet and Sheet After Duration)

A halftone image (30H image) was formed to visually observe and evaluate for dot reproducibility of the image on the basis of the following criteria. In addition, the 30H image is a value representing 256 gradation levels in hexadecimal number and is a halftone image where 00H corresponds to solid white and FFH corresponds to solid black.

A: The image provides no feeling of roughness and is smooth.

B: The image provides not much feeling of roughness.

C: The image provides some feeling of roughness, which is a level with no practical problems.

D: The image provides feeling of roughness.

E: The image provides too much feeling of roughness.

(5) Leak (White Spot Evaluation (Before Duration and After Duration))

A similar toner is prepared separately from a developer used for duration and a solid image (a toner coverage of 0.55 mg/cm$^2$) is output until the toner concentration becomes half of the initial value by stopping the supply of the toner, and thereafter, the initial leak test is carried by the following method. In addition, a developer which is completed with an evaluation after duration is used and the toner concentration is adjusted to become half of the initial value by stopping the supply of the toner. Thereafter, the test after duration is carried by the following method.

A solid black image is output consecutively five times on A4 plain paper and the number of points having a white spot with a diameter of 1 mm or more on the image is counted. Thereafter, the evaluation was performed from the total number in the five sheets.

A: Zero

B: 1 or more and less than 10

C: 10 or more and less than 20

D: 20 or more and less than 100

E: 100 or more (6) Charging Amount Decrease when Allowed to Stand

After the 30000-sheet duration under the environment of high humidity and high temperature (30° C., 80% RH), the toner was allowed to stand for 72 hours under the condition where the power plug of the machine was disconnected and then the machine was turned on and developing was performed in the same manner as in the initial evaluation. At that time, the charging amount of the toner on the photosensitive member was measured and the difference between the toner charging amount at the time of completion of the duration, and the toner charging amount after being allowed to stand for 72 hours was defined as a charging amount change when allowed to stand.

A: Less than 2.0 mC/kg

B: 2.0 mC/kg or more and less than 4.0 mC/kg

C, 4.0 mC/kg or more and less than 6.0 mC/kg

D: 6.0 mC/kg or more and less than 8.0 mC/kg

E: 8.0 mC/kg or more

Examples 2 to 7

A developer was prepared by adding 8 parts by mass of the toner 1 to 92 parts by mass of the carriers B to G and followed by mixing for 2 minutes with a Turbler mixer. The evaluation was performed in the same manner as in Example 1 except for using the resulting developer. The evaluation results are shown in Tables 5 and 6.

Examples 8 and 9

A developer was prepared by adding 6 parts by mass of the toner 1 to 94 parts by mass of the carriers H to I and followed by mixing for 2 minutes with a Turbler mixer. The evaluation was performed in the same manner as in Example 1 except for using the resulting developer. The evaluation results are shown in Tables 5 and 6.

Example 10

A developer was prepared by adding 11 parts by mass of the toner 1 to 89 parts by mass of the carrier O, followed by mixing for 2 minutes with a Turbler mixer. The evaluation was performed in the same manner as in Example 1 except for using the resulting developer. The evaluation results are shown in Tables 5 and 6.

Example 11

A developer was prepared in the same manner as in Example 1 except for using the carrier R instead of the carrier A. The evaluation was performed in the same manner as in Example 1 except for using the resulting developer. The evaluation results are shown in Tables 5 and 6.

Example 12

A developer was prepared by adding 6 parts by mass of the toner 2 to 94 parts by mass of the carrier A and followed by mixing for 2 minutes with a Turbler mixer. The evaluation was performed in the same manner as in Example 1 except for using the resulting developer. The evaluation results are shown in Tables 5 and 6.

Example 13

A developer was prepared in the same manner as in Example 12 except for using the toner 4 instead of the toner 2. The evaluation was performed in the same manner as in Example 1 except for using the resulting developer. The evaluation results are shown in Tables 5 and 6.

Example 14

A developer was prepared in the same manner as in Example 12 except for using the toner 5 instead of the toner 2. The evaluation was performed in the same manner as in Example 1 except for using the resulting developer. The evaluation results are shown in Tables 5 and 6.

Example 15

A developer was prepared by adding 6 parts by mass of the toner 5 to 94 parts by mass of the carrier H and followed by mixing for 2 minutes with a Turbler mixer. The evaluation was performed in the same manner as in Example 1 except for using the resulting developer. The evaluation results are shown in Tables 5 and 6.

Example 16

A developer was prepared by adding 11 parts by mass of the toner 5 to 89 parts by mass of the carrier L and followed by mixing for 2 minutes with a Turbler mixer. The evaluation was performed in the same manner as in Example 1 except for using the resulting developer. The evaluation results are shown in Tables 5 and 6.

Example 17

A developer was prepared in the same manner as in Example 16 except for using the carrier M instead of the carrier L. The evaluation was performed in the same manner as in Example 1 except for using the resulting developer. The evaluation results are shown in Tables 5 and 6.

Example 18

A developer was prepared by adding 4 parts by mass of the toner 5 to 96 parts by mass of the carrier N, and followed by mixing for 2 minutes with a Turbler mixer. The evaluation was performed in the same manner as in Example 1 except for using the resulting developer. The evaluation results are shown in Tables 5 and 6.

Comparative Example 1

A developer was prepared by adding 6 parts by mass of the toner 5 to 94 parts by mass of the carrier J, followed by mixing for 2 minutes with a Turbler mixer. The evaluation was performed in the same manner as in Example 1 except for using the resulting developer. The evaluation results are shown in Tables 5 and 6.

Comparative Example 2

A developer was prepared in the same manner as in Comparative Example 1 except for using the carrier K instead of the carrier J. The evaluation was performed in the same manner as in Example 1 except for using the resulting developer. The evaluation results are shown in Tables 5 and 6.

Comparative Example 3

A developer was prepared by adding 4 parts by mass of the toner 5 to 96 parts by mass of the carrier P, followed by mixing for 2 minutes with a Turbler mixer. The evaluation was performed in the same manner as in Example 1 except for using the resulting developer. The evaluation results are shown in Tables 5 and 6.

Comparative Example 4

A developer was prepared in the same manner as in Comparative Example 3 except for using the carrier Q instead of the carrier P. The evaluation was performed in the same manner as in Example 1 except for using the resulting developer. The evaluation results are shown in Tables 5 and 6.

Comparative Example 5

A developer was prepared by adding 4 parts by mass of the toner 6 to 96 parts by mass of the carrier Q and followed by mixing for 2 minutes with a Turbler mixer. The evaluation was performed in the same manner as in Example 1 except for using the resulting developer. The evaluation results are shown in Tables 5 and 6.

TABLE 5

| | | | | Evaluation under the environment of normal temperature and low humidity (N/L) | | | | | | | | |
|---|---|---|---|---|---|---|---|---|---|---|---|---|
| | | | | Before duration | | | | After duration (after 30000-sheet) | | | | |
| | Magnetic Carrier | Toner | Toner Concentration (% by mass) | Contrast required | Charging Amount (mC/kg) | Dot Reproducibility | Leak | Contrast required | Charging Amount (mC/kg) | Charging Amount Change | Dot Reproducibility | Leak |
| Example 1 | A | 1 | 8 | A(340) | −41.2 | A | A(0) | A(350) | −42.9 | A(0.9) | A | A(0) |
| Example 2 | B | 1 | 8 | A(370) | −41.8 | A | B(1) | B(400) | −43.6 | B(1.8) | A | B(1) |
| Example 3 | C | 1 | 8 | A(370) | −40.1 | A | B(2) | B(410) | −42.1 | B(2.0) | B | B(8) |
| Example 4 | D | 1 | 8 | A(350) | −40.9 | A | A(0) | A(360) | −41.5 | A(0.6) | A | A(0) |
| Example 5 | E | 1 | 8 | A(330) | −38.3 | A | B(1) | A(370) | −40.3 | B(2.0) | A | B(2) |
| Example 6 | F | 1 | 8 | A(370) | −42.6 | A | A(0) | B(380) | −43.6 | B(1.0) | A | A(0) |
| Example 7 | G | 1 | 8 | B(400) | −43.7 | A | A(0) | C(440) | −46.9 | B(3.2) | A | A(0) |
| Example 8 | H | 1 | 6 | A(340) | −35.3 | A | B(1) | A(360) | −36.9 | B(1.6) | A | B(9) |
| Example 9 | I | 1 | 6 | A(360) | −40.1 | A | B(1) | B(380) | −42.7 | B(2.6) | A | B(2) |
| Example 10 | O | 1 | 11 | B(380) | −43.0 | A | A(0) | B(380) | −43.7 | A(0.7) | A | B(1) |
| Example 11 | R | 1 | 8 | A(340) | −40.8 | A | B(1) | A(350) | −41.6 | A(0.8) | A | B(2) |

TABLE 5-continued

| | | | | Evaluation under the environment of normal temperature and low humidity (N/L) | | | | | | | | |
|---|---|---|---|---|---|---|---|---|---|---|---|---|
| | | | | Before duration | | | | After duration (after 30000-sheet) | | | | |
| | Magnetic Carrier | Toner | Toner Concentration (% by mass) | Contrast required | Charging Amount (mC/kg) | Dot Reproducibility | Leak | Contrast required | Charging Amount (mC/kg) | Charging Amount Change | Dot Repro-ducibility | Leak |
| Example 12 | A | 2 | 6 | B(410) | −47.8 | A | A(0) | C(440) | −49.5 | B(1.7) | A | A(0) |
| Example 13 | A | 3 | 8 | A(350) | −41.0 | A | A(0) | B(390) | −43.9 | B(2.9) | B | A(0) |
| Example 14 | A | 4 | 8 | B(380) | −40.5 | B | A(0) | B(400) | −42.9 | B(2.4) | C | B(1) |
| Example 15 | H | 4 | 6 | A(330) | −33.9 | B | B(2) | A(360) | −36.5 | B(2.6) | B | C(11) |
| Example 16 | L | 4 | 11 | B(380) | −36.9 | A | B(5) | B(400) | −38.9 | B(2.0) | B | B(2) |
| Example 17 | M | 4 | 11 | B(380) | −40.5 | A | B(1) | B(400) | −42.3 | B(1.8) | A | B(1) |
| Example 18 | N | 4 | 4 | B(380) | −40.1 | B | B(5) | C(430) | −44.6 | C(4.5) | C | C(13) |
| Comparative Example 1 | J | 4 | 6 | A(350) | −35.7 | A | B(5) | B(400) | −41.3 | D(5.6) | C | D(25) |
| Comparative Example 2 | K | 4 | 6 | A(370) | −37.9 | A | B(9) | C(420) | −44.1 | D(6.3) | C | D(33) |
| Comparative Example 3 | P | 4 | 4 | A(350) | −35.9 | A | B(1) | B(380) | −39.7 | C(3.8) | B | D(20) |
| Comparative Example 4 | Q | 4 | 4 | A(370) | −38.6 | A | B(1) | B(410) | −42.9 | C(4.3) | B | D(23) |
| Comparative Example 5 | Q | 5 | 4 | C(420) | −41.6 | C | C(13) | E(470) | −47.3 | D(5.7) | E | E(113) |

TABLE 6

| | | | Evaluation under the environment of high temperature and high humidity (H/H) | | | | | | | |
|---|---|---|---|---|---|---|---|---|---|---|
| | | | Before duration | | | After duration (after 30000-sheet) | | | | |
| | Magnetic Carrier | Toner | Contrast required | Charging Amount (mC/kg) | Dot Reproducibility | Contrast required | Charging Amount (mC/kg) | Charging Amount Change | Dot Repro-ducibility | Charging Amount Change when allowed to stand |
| Example 1 | A | 1 | A(310) | −35.6 | A | B(290) | −32.9 | B(2.7) | B | A(1.9) |
| Example 2 | B | 1 | A(320) | −35.0 | A | B(290) | −31.8 | C(3.2) | B | B(2.2) |
| Example 3 | C | 1 | A(320) | −33.8 | A | B(290) | −30.3 | C(3.5) | C | C(5.0) |
| Example 4 | D | 1 | A(310) | −34.7 | A | A(300) | −32.9 | B(1.8) | A | A(1.8) |
| Example 5 | E | 1 | B(280) | −31.3 | A | B(260) | −26.9 | C(4.4) | C | B(3.2) |
| Example 6 | F | 1 | A(320) | −35.9 | A | A(300) | −33.2 | B(2.7) | A | A(1.9) |
| Example 7 | G | 1 | A(330) | −35.8 | A | B(280) | −31.1 | C(4.7) | B | B(2.1) |
| Example 8 | H | 1 | A(320) | −32.0 | B | A(300) | −29.7 | B(2.3) | B | B(3.9) |
| Example 9 | I | 1 | A(310) | −35.0 | A | B(260) | −32.1 | B(2.9) | B | B(2.5) |
| Example 10 | O | 1 | A(310) | −33.3 | A | A(300) | −32.0 | B(1.3) | A | B(2.8) |
| Example 11 | R | 1 | A(320) | −36.3 | A | A(300) | −33.7 | B(2.6) | A | B(2.0) |
| Example 12 | A | 2 | A(370) | −37.4 | A | A(340) | −34.1 | C(3.3) | B | B(2.0) |
| Example 13 | A | 3 | A(300) | −35.0 | B | B(270) | −31.7 | C(3.3) | C | B(2.2) |
| Example 14 | A | 4 | A(320) | −34.6 | B | B(290) | −29.8 | C(4.8) | C | B(2.1) |
| Example 15 | H | 4 | A(300) | −29.5 | B | B(270) | −26.4 | C(3.1) | C | C(4.9) |
| Example 16 | L | 4 | A(330) | −31.7 | A | A(310) | −26.7 | C(5.0) | C | C(5.3) |
| Example 17 | M | 4 | A(300) | −32.2 | A | B(280) | −29.2 | C(3.0) | C | B(3.3) |
| Example 18 | N | 4 | A(300) | −32.5 | B | B(260) | −27.9 | C(4.6) | C | B(3.7) |
| Comparative Example 1 | J | 4 | A(300) | −31.8 | B | C(250) | −26.3 | D(5.5) | D | C(5.8) |
| Comparative Example 2 | K | 4 | A(300) | −33.0 | B | B(260) | −27.2 | D(5.8) | D | D(6.2) |
| Comparative Example 3 | P | 4 | B(280) | −29.9 | B | C(250) | −26.0 | C(3.9) | C | D(6.1) |
| Comparative Example 4 | Q | 4 | B(290) | −31.2 | B | B(260) | −27.2 | C(5.0) | D | D(7.9) |
| Comparative Example 5 | Q | 5 | A(300) | −32.5 | C | B(260) | −27.9 | C(4.6) | E | E(8.5) |

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Applications No. 2008-056498, filed Mar. 6, 2008, and No. 2008-203252, filed Aug. 6, 2008, which are hereby incorporated by reference herein in their entirety.

The invention claimed is:

1. A magnetic carrier wherein a carrier core surface is coated with a copolymer whose copolymerization components are a monomer having a structure represented by the following formula (A1) and a macromonomer having a structure represented by the following formula (A2):

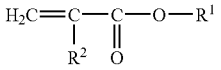

(A1)

wherein $R^1$ represents a hydrocarbon group having 4 or more carbon atoms and $R^2$ represents H or $CH_3$;

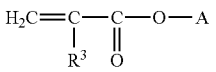

(A2)

wherein A represents a polymer whose polymerization component is one or two or more compounds selected from the group consisting of methyl acrylate, methyl methacrylate, butyl acrylate, butyl methacrylate, 2-ethylhexyl acrylate, 2-ethylhexyl methacrylate, styrene and acrylonitrile, and $R^3$ represents H or $CH_3$.

2. The magnetic carrier according to claim 1, wherein the copolymer further contains a methyl methacrylate monomer as a copolymerization component and the copolymerization ratio of the methyl methacrylate monomer is 1% by mass or more and less than 50% by mass.

3. The magnetic carrier according to claim 1, wherein the magnetic carrier has a true density of 2.5 g/cm$^3$ or more and 4.2 g/cm$^3$ or less.

4. A two-components developer comprising a magnetic carrier and a toner, wherein the magnetic carrier is a carrier according to claim 1, and the toner has i) toner particles having a binder resin and a colorant, has ii) a weight average particle diameter (D4) of 3.0 μm or more and 8.0 μm or less, and has iii) an average circularity of 0.940 or more and 1.000 or less.

5. The magnetic carrier according to claim 2, wherein the magnetic carrier has a true density of 2.5 g/cm$^3$ or more and 4.2 g/cm$^3$ or less.

6. A two-components developer comprising a magnetic carrier and a toner, wherein the magnetic carrier is a carrier according to claim 2, and the toner has i) toner particles having a binder resin and a colorant, has ii) a weight average particle diameter (D4) of 3.0 μm or more and 8.0 μm or less, and has iii) an average circularity of 0.940 or more and 1.000 or less.

7. A two-components developer comprising a magnetic carrier and a toner, wherein the magnetic carrier is a carrier according to claim 3, and the toner has i) toner particles having a binder resin and a colorant, has ii) a weight average particle diameter (D4) of 3.0 μm or more and 8.0 μm or less, and has iii) an average circularity of 0.940 or more and 1.000 or less.

8. A two-components developer comprising a magnetic carrier and a toner, wherein the magnetic carrier is a carrier according to claim 5, and the toner has i) toner particles having a binder resin and a colorant, has ii) a weight average particle diameter (D4) of 3.0 μm or more and 8.0 μm or less, and has iii) an average circularity of 0.940 or more and 1.000 or less.

* * * * *